US010654300B2

(12) United States Patent
Okushima et al.

(10) Patent No.: US 10,654,300 B2
(45) Date of Patent: May 19, 2020

(54) LIQUID EJECTION APPARATUS WITH LIQUID IN PRESSURE CHAMBER IN LIQUID EJECTION HEAD BEING CIRCULATED BETWEEN PRESSURE CHAMBER AND OUTSIDE

(71) Applicant: CANON KABUSHIKI KAISHA, Tokyo (JP)

(72) Inventors: Shingo Okushima, Kawasaki (JP); Ryosuke Hirokawa, Kawasaki (JP); Toru Ohnishi, Yokohama (JP); Yoichi Takada, Yokohama (JP); Mitsutoshi Noguchi, Kawaguchi (JP); Takuto Moriguchi, Kawakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 16/020,078

(22) Filed: Jun. 27, 2018

(65) Prior Publication Data

US 2019/0009592 A1 Jan. 10, 2019

(30) Foreign Application Priority Data

Jul. 4, 2017 (JP) ..... 2017-131276

(51) Int. Cl.
*B41J 29/377* (2006.01)
*B41J 2/005* (2006.01)
(Continued)

(52) U.S. Cl.
CPC ..... *B41J 29/377* (2013.01); *B41J 2/0057* (2013.01); *B41J 2/14016* (2013.01); *B41J 29/17* (2013.01); *B41J 2002/012* (2013.01)

(58) Field of Classification Search
CPC ..... B41J 29/377; B41J 29/17; B41J 2/14016; B41J 2/0057; B41J 2002/012; B41J 2/01
See application file for complete search history.

(56) References Cited

U.S. PATENT DOCUMENTS 4,920,361 A 4/1990 Arahara et al.
8,042,906 B2 10/2011 Chiwata et al.
(Continued)

FOREIGN PATENT DOCUMENTS

CN 101417533 A 4/2009
CN 101804727 A 8/2010
JP 5085893 B2 11/2012

OTHER PUBLICATIONS

Extended European Search Report dated Nov. 6, 2018, in European Patent Application No. 18181348.6.
(Continued)

*Primary Examiner* — Henok D Legesse
(74) *Attorney, Agent, or Firm* — Venable LLP

(57) ABSTRACT

A liquid ejection apparatus includes a liquid ejection head which is provided with a pressure chamber having, in the inside thereof, an energy-generating element, a transfer body onto which a liquid is ejected through the liquid ejection head to form an image, and a pressing unit which presses a recording medium against the transfer body to transfer the image formed on the transfer body onto the recording medium, wherein the liquid ejection apparatus further includes a heating unit for heating the transfer body during a period from the ejection of the liquid through the liquid ejection head and until the pressing of the recording medium by means of the pressing unit, and the liquid in the pressure chamber in the liquid ejection head is circulated between the pressure chamber and the outside of the pressure chamber.

13 Claims, 23 Drawing Sheets

(51) Int. Cl.

| | |
|---|---|
| ***B41J 2/14*** | (2006.01) |
| ***B41J 29/17*** | (2006.01) |
| *B41J 2/01* | (2006.01) |

(56) References Cited

U.S. PATENT DOCUMENTS

| | | | | |
|---|---|---|---|---|
| 8,573,758 | B2 | 11/2013 | Inoue et al. | |
| 9,102,137 | B2 | 8/2015 | Koitabashi et al. | |
| 9,527,314 | B2 | 12/2016 | Moriguchi et al. | |
| 2008/0006176 | A1 | 1/2008 | Houjou | |
| 2009/0079784 | A1* | 3/2009 | Chiwata | B41J 2/2114 347/21 |
| 2009/0165937 | A1 | 7/2009 | Inoue et al. | |
| 2010/0208010 | A1* | 8/2010 | Inoue | B41J 2/14145 347/85 |
| 2012/0105562 | A1* | 5/2012 | Sekiguchi | B41J 2/01 347/103 |
| 2014/0218424 | A1 | 8/2014 | Koitabashi et al. | |
| 2016/0303847 | A1 | 10/2016 | Soma et al. | |
| 2016/0375680 | A1 | 12/2016 | Nishitani et al. | |
| 2017/0217191 | A1 | 8/2017 | Hirokawa et al. | |
| 2017/0217216 | A1 | 8/2017 | Ohnishi et al. | |
| 2017/0341381 | A1 | 11/2017 | Aoki et al. | |
| 2018/0311951 | A1 | 11/2018 | Sakamoto et al. | |
| 2018/0326719 | A1 | 11/2018 | Masuda et al. | |
| 2018/0326755 | A1 | 11/2018 | Ohnishi et al. | |
| 2018/0326756 | A1 | 11/2018 | Hirokawa et al. | |
| 2018/0345657 | A1 | 12/2018 | Inoue et al. | |
| 2019/0001710 | A1 | 1/2019 | Hirokawa et al. | |
| 2019/0009515 | A1 | 1/2019 | Deguchi et al. | |
| 2019/0009549 | A1 | 1/2019 | Takada et al. | |
| 2019/0009550 | A1 | 1/2019 | Inoue et al. | |
| 2019/0009577 | A1 | 1/2019 | Hirokawa et al. | |
| 2019/0009578 | A1 | 1/2019 | Takeuchi et al. | |
| 2019/0009579 | A1 | 1/2019 | Inoue et al. | |
| 2019/0009589 | A1 | 1/2019 | Hirokawa et al. | |
| 2019/0009600 | A1 | 1/2019 | Moriguchi et al. | |

OTHER PUBLICATIONS

Office Action dated Jul. 23, 2019, issued in Russian Patent Application No. 2018123934.
Mar. 30, 2020 Chinese Official Action in Chinese Patent Appln. No. 201810720484.5.

* cited by examiner

LIQUID EJECTION APPARATUS WITH LIQUID IN PRESSURE CHAMBER IN LIQUID EJECTION HEAD BEING CIRCULATED BETWEEN PRESSURE CHAMBER AND OUTSIDE

BACKGROUND OF THE INVENTION

Field of the Invention

The present disclosure relates to a liquid ejection apparatus.

Description of the Related Art

As one of image recording modes, a mode is known in which a liquid composition containing a coloring material (an ink) is applied onto an intermediate transfer body using a liquid ejection head (an inkjet recording head) to form an image and the image is transferred onto a recording medium such as paper to form an image.

In this mode, the transfer is generally carried out while heating the intermediate transfer body. In Japanese Patent No. 5085893, a method is disclosed in which the rate of the melting of a resin by heating during transfer can be improved by heating a transfer part (in which an image is to be transferred from an intermediate transfer body onto a recording medium) to a temperature higher than the minimum film-forming temperature (MFT) of a resin emulsion in an ink.

In the method disclosed in Japanese Patent No. 5085893, however, the heating of the transfer part may affect the ejection through a liquid ejection head. Namely, the volatilization of water or the like in an ink through an ejection orifice is accelerated under a relatively high temperature condition. As a result, the thickening of the ink and the change in concentration of the coloring material occur in the vicinity of the ejection orifice, and consequently the ejection failure of an ink and the unevenness of image density may occur. As stated above, in a device in which an ejection object medium (i.e., a medium onto which a liquid is to be ejected through a liquid ejection head, e.g., a transfer body and a recording medium) is heated, the ejection through the liquid ejection head is carried out under a relatively high temperature environment due to the influence of heat coming from the medium, and therefore the ejection through the liquid ejection head may be adversely affected.

SUMMARY OF THE INVENTION

The object of the present disclosure is to provide a liquid ejection apparatus whereby it becomes possible to eject a liquid without being affected by heat even when an ejection object medium onto which ejection is carried out through a liquid ejection head, e.g., an intermediate transfer body and a recording medium, is heated and therefore the ejection through the liquid ejection head is performed under a relatively high temperature condition due to the influence of the heat.

In order to achieve the above object, a liquid ejection apparatus according to the present disclosure includes: a liquid ejection head which communicates with an ejection orifice for ejecting a liquid therethrough and which is provided with a pressure chamber having, in the inside thereof, an energy-generating element capable of generating an energy to be utilized for the ejection of the liquid; a transfer body onto which the liquid is ejected through the liquid ejection head to form an image; and a pressing unit which presses a recording medium against the transfer body to transfer an image formed on the transfer body onto the recording medium, wherein the liquid ejection apparatus further includes a heating unit for heating the transfer body during a period from the ejection of the liquid through the liquid ejection head and until the pressing of the recording medium by means of the pressing unit, and the liquid in the pressure chamber in the liquid ejection head is circulated between the pressure chamber and the outside of the pressure chamber.

In a liquid ejection apparatus of this type, the image transfer properties can be improved by heating a transfer body during the transfer of an image on the transfer body onto a recording medium. In addition, even when a liquid, e.g., water, is volatilized through an ejection orifice as the result of the heating of the transfer body to cause the thickening of the liquid and the change in the density of a coloring material, it also becomes possible to discharge the liquid and supplement a fresh liquid. As a result, the occurrence of ejection failure and image unevenness can be prevented.

Further features of the present invention will become apparent from the following description of exemplary embodiments with reference to the attached drawings.

DESCRIPTION OF THE EMBODIMENTS

Hereinafter, an inkjet recording device will now be described in detail as one embodiment of the liquid ejection apparatus of the present disclosure in accordance with the accompanying drawings.

Figure 1:
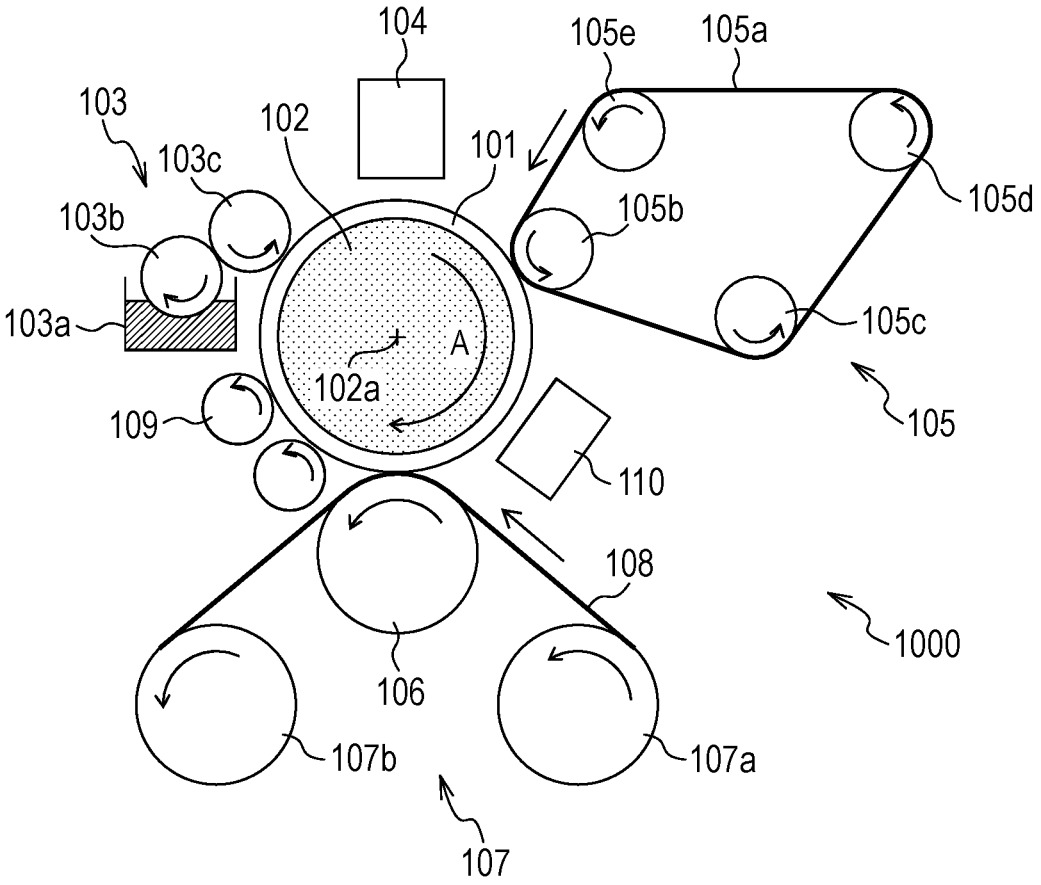
FIG. 1 is a schematic diagram illustrating one configuration example of a transfer-type inkjet recording device.
Figure 2:
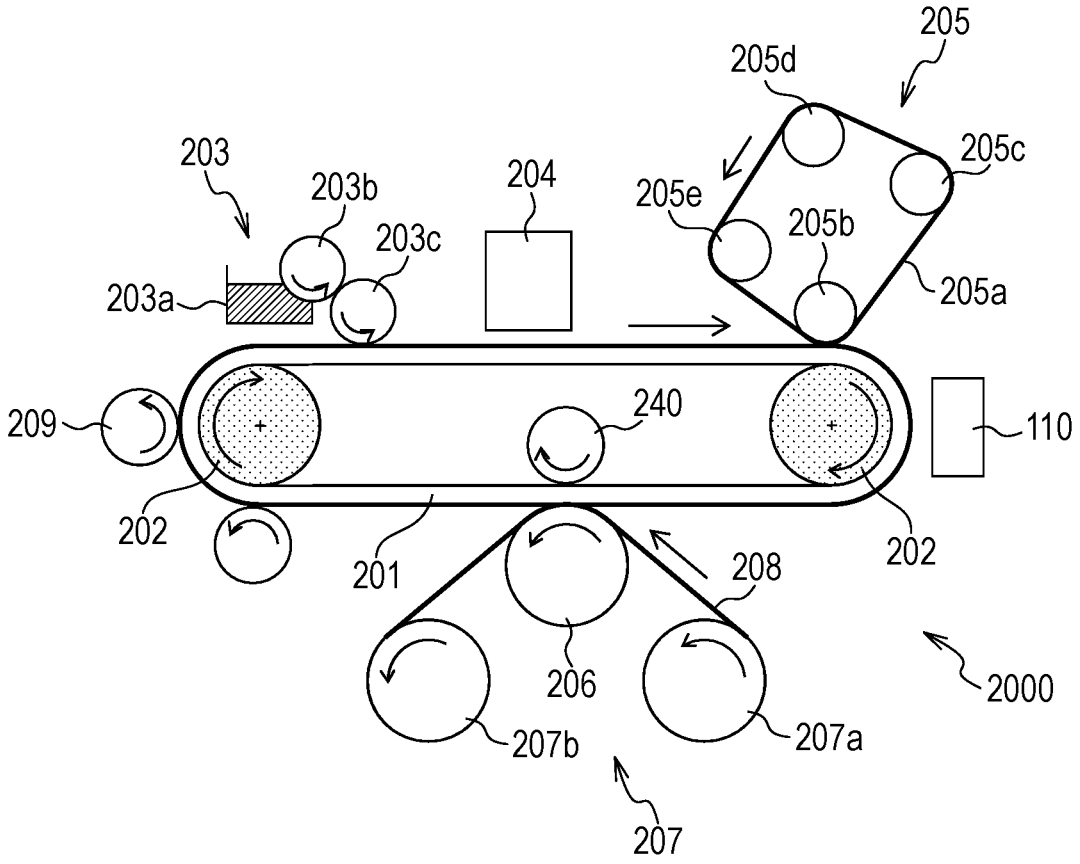
FIG. 2 is a schematic diagram illustrating another configuration example of the transfer-type inkjet recording device.

FIGS. 1 and 2 are schematic diagrams respectively illustrating configuration examples of the liquid ejection apparatus according to the present embodiment which is typified by a transfer-type inkjet recording device. FIG. 1 shows a sheet-fed inkjet recording device 1000 in which an image formed with a liquid such as an ink is transferred onto a recording medium 108 through a drum-shaped transfer body 101 to form an image on the recording medium 108. In an inkjet recording device 2000 which is a liquid ejection apparatus shown in FIG. 2, on the other hand, an endless belt-like transfer body 201, which is preferred because of the smaller heat capacity and more easiness of temperature controlling thereof compared with the drum-shaped transfer body 101 shown in FIG. 1, is provided in place of the drum-shaped transfer body 101 shown in FIG. 1. In the inkjet recording device 2000 shown in FIG. 2, an opposing roller 240 for pressing the transfer body 201 against a pressing member 206 is provided. A position on a recording medium 208 at which an ink image is transferred from the transfer body 201 is not limited to the position shown in FIG. 2. For example, it is possible to make a support member 202 on a side facing a heating unit 110 serve as the opposing roller. Alternatively, it also possible to make the support member 202 serve as a heating unit for heating the transfer body 201. In the inkjet recording device 2000 shown in FIG. 2, the support member 202, a reaction liquid applying device 203, an ink applying device 204 (a liquid ejection head), a liquid absorbing device 205 and the pressing member 206 have the same configurations as those shown in FIG. 1. A recording medium conveyance device 207 and the recording medium 208 also have the same configurations as those shown in FIG. 1. Therefore, only the configuration of the inkjet recording device 1000 shown in FIG. 1 will be described hereinbelow.

A liquid ejection head for ejecting a liquid (e.g., an ink) and a liquid ejection apparatus equipped with the liquid ejection head can be applied to a printing device, a printer, a copying machine and an industrial recording device combined with various processing devices. For example, the liquid ejection head and the liquid ejection apparatus can also be used in a 3D printer or for the production of a biochip, the printing of an electronic circuit, the production of a semiconductor substrate or the like.

As shown in FIG. 1, the liquid ejection apparatus 1000 typified by an inkjet recording device is equipped with a transfer body 101, a reaction liquid applying device 103, an ink applying device 104, a liquid absorbing device 105, a heating unit 110 and a pressing member 106. The transfer body 101, which is a medium onto which a liquid is to be ejected (applied) from the ink applying device 104, is a rotating body which is supported by a support member 102 and can rotate about a rotation axis 102*a*. The reaction liquid applying device 103 can apply a reaction liquid capable of reacting with a color ink to the transfer body 101, and the ink applying device 104 is equipped with a liquid ejection head and can apply the color ink onto the transfer body 101 having the reaction liquid applied thereon to form an ink image (which is an image formed by the ink) on the transfer body. The liquid absorbing device 105 absorbs a liquid component from the ink image on the transfer body 101, and the heating unit 110 heats the ink image on the transfer body 101 to a temperature equal to or higher than the minimum film-forming temperature (MFT) of a film-forming component contained in the ink. The pressing member 106 presses the recording medium 108 against the transfer body 101 for the purpose of transferring the ink image on the transfer body (from which the liquid component has been removed and has been heated to a temperature equal to or higher than the MFT) onto the recording medium 108 such as paper. If necessary, the inkjet recording device 1000 may be further equipped with a transfer body cleaning member 109 for cleaning the surface of the transfer body 101 after the transfer of the ink image. As a matter of course, each of the transfer body 101, the reaction liquid applying device 103, the liquid head in the ink applying device 104, the liquid absorbing device 105 and the transfer body cleaning member 109 has a length corresponding to the width (i.e., the length in the direction orthogonal to the conveyance direction) of the recording medium 108.

The transfer body 101 moves along with the rotation of the support member 102 by the rotation axis 102*a* in the direction of arrow A shown in FIG. 1. The reaction liquid and the ink are applied to the moving transfer body 101 in sequence by means of the reaction liquid applying device 103 and the ink applying device 104, respectively, to form an ink image on the transfer body 101. The ink image formed on the transfer body 101 is moved to a position at which the ink image can contact with the liquid absorbing member 105*a* in the liquid absorbing device 105 along with the movement of the transfer body 101.

The liquid absorbing member 105*a* in the liquid absorbing device 105 moves in synchronization with the rotation of the transfer body 101. The ink image formed on the transfer body 101 is in a state contacting with the moving liquid absorbing member 105*a*, while the liquid absorbing member 105*a* removes the liquid component from the ink image on the transfer body. In this contacting state, it is especially preferred that the liquid absorbing member 105*a* is pressed against the transfer body 101 with a specific pressing force, from the viewpoint of the effective operation of the liquid absorbing member 105*a*.

In other words, the removal of the liquid component is the concentration of the ink constituting the image formed on the transfer body 101. The matter that the ink is concentrated means that the ratio of the content of a solid material (e.g., a coloring material and a resin) relative to the content of the liquid component in the ink increases with the decrease in the liquid component contained in in the ink.

Subsequently, the ink image formed on the transfer body 101 is moved to a position facing the heating unit 110 along with the movement of the transfer body 101, and is then heated to a temperature equal to or higher than the MFT of the film-forming component contained in the ink. In the ink image from which the liquid component has been removed and has been heated to the temperature equal to or higher than the MFT, the ink is concentrated compared with the ink image from which the liquid is not removed yet, and is in a state where the solid material is softened. Furthermore, the ink image on the transfer body 101 is moved to a pressing member 106, which contacts with the recording medium 108 that is conveyed by means of the recording medium conveyance device 107, along with the movement of the transfer body 101. The pressing member 106 presses the recording medium 108 against the transfer body 101 during the contact of the ink image (from which the liquid has been removed and in which the solid material has been softened) with the recording medium 108, whereby the ink image on the transfer body 101 is transferred onto the recording medium 108. The ink image transferred on the recording medium 108 is a reversed image of each of the ink image before the removal of the liquid and the ink image after the removal of the liquid.

In the present embodiment, the ink is applied onto the transfer body 101 after the application of the reaction liquid onto the transfer body 101 to form an image, and therefore the ink still remains without reacting with the reaction liquid on a non-image region on which no image is formed with the ink on the transfer body 101. In contrast, the liquid absorbing member 105*a* can contact with the liquid component in the image as well as the unreacted reaction liquid, and therefore the liquid component in the reaction liquid can also be removed. Therefore, the wording "the liquid component is removed from the image" does not have a limiting meaning that "the liquid component is removed only from the image", but means that "the liquid component is removed from at least an image on the transfer body".

The liquid component is not particularly limited, as long as the liquid component does not have a certain shape, has fluidity and has almost a constant volume. Examples of the liquid component include water contained in an ink or a reaction liquid, and an organic solvent.

Hereinbelow, each component of the transfer-type inkjet recording device according to the present embodiment will be described in detail.

<Transfer Body>

A transfer body 101 has a surface layer including an image-forming surface. As the material for the surface layer, various materials including a resin and a ceramic can be used appropriately, and a material having a high compressive elastic modulus is preferred from the viewpoint of durability and the like. Specific examples of the material include an acrylic resin, an acrylic silicone resin, a fluorinated resin, and a condensation product produced by condensing a hydrolyzable organic silicon compound. For the purpose of improving wettability, transfer properties and the like of a reaction liquid, a surface treatment may be applied. Examples of the surface treatment include a flame treatment, a corona treatment, a plasma treatment, a polishing treatment, a roughening treatment, an active energy ray irradiation treatment, an ozone treatment, a surfactant treatment and a silane coupling treatment. Two or more of these treatments may be employed in combination. It is also possible to form an arbitrary surface form on the surface layer.

It is preferred that the transfer body 101 has a compressible layer that has a function to absorb a fluctuating pressure. When a compressible layer is provided, it becomes possible to disperse the fluctuating pressure by the compressible layer even when the fluctuation in pressure occurs locally, satisfactory transfer properties can be maintained even in high-speed image recording. Examples of the material for the compressible layer include an acrylonitrile-butadiene rubber, an acrylic rubber, a chloroprene rubber, a urethane rubber and a silicone rubber. The compressible layer is preferably one in which a predetermined amount of a vulcanizing agent, a vulcanization accelerator or the like is added during molding of the rubber material and a filler such as a foaming agent, hollow microparticles or common salt is added as required to make the compressible layer porous. Cell parts are compressed accompanied by the change in volume along with various pressure fluctuations. Therefore, the deformation of the transfer body 101 in a direction other than the compression direction becomes small, and more steady transfer properties and durability can be achieved. The porous rubber material may be one having a continuous cell structure in which cells are communicated with each other or one having a closed cell structure in which cells are separated from each other, or may be a combination of these structures.

The transfer body 101 preferably has an elastic layer between the surface layer and the compressible layer. As the material for the elastic layer, various materials including resins and ceramics can be used appropriately. From the viewpoint of the processing properties and the like, an elastomer material and a rubber material can be used preferably. Specific examples of the material include a fluorosilicone rubber, a phenylsilicone rubber, a fluorine rubber, a chloroprene rubber, a urethane rubber, a nitrile rubber and an ethylene propylene rubber. In addition, a natural rubber, a styrene rubber, an isoprene rubber, a butadiene rubber, an ethylene/propylene/butadiene copolymer, a nitrile butadiene rubber and the like can also be used. Among these materials, a silicone rubber, a fluorosilicone rubber and a phenylsilicone rubber are preferred from the viewpoint of dimensional stability and durability because of their small compressive permanent strains, and are also preferred from the viewpoint of transfer properties because of their small fluctuations in elastic modulus.

It is also possible to use an adhesive agent or a double-sided tape between the layers (the surface layer, the elastic layer, the compressible layer) constituting the transfer body 101, for the purpose of fixing and retaining the layers. For the purpose of preventing the lateral extension upon the attachment to a device or maintaining the body, a reinforcing layer having a high compressive elastic modulus may be provided. As the reinforcing layer, a woven fabric may be used. The transfer body 101 can be produced by combining layers made from the above-mentioned materials arbitrarily. The size of the transfer body 101 may be selected arbitrarily depending on the intended image size.

The shape of the transfer body is not particularly limited, and a sheet-like shape, a roller-like shape, a belt-like shape, an endless web-like shape and the like can be employed in addition to the drum-like shape shown in the drawing.

<Support Member>

As the method for supporting the transfer body 101 by the support member 102, an adhesive agent or a double-sided tape can be used. Alternatively, it also possible to attach an installation member made from a metal, a ceramic, a resin or the like to the transfer body 101 and allow the transfer body 101 to be supported by the support member 102 using the installation member.

From the viewpoint of conveyance accuracy and durability, the support member 102 is required to have a certain level of structural strength. As the material for the support member 102, a metal, a ceramic, a resin or the like is preferably used. Particularly for the purpose of improving stiffness or dimensional accuracy for withstanding the pressurization during transfer and for the purpose of reducing inertia during operation to improve control responsiveness, the following materials can be used preferably: aluminum, iron, a stainless steel, an acetal resin, an epoxy resin, a polyimide, a polyethylene, poly(ethylene terephthalate), nylon, polyurethane, silica ceramics and alumina ceramics. It is also preferred to use two or more of these materials in combination.

<Reaction Liquid Applying Device>

The reaction liquid applying device 103 to be used in the present embodiment is a gravure offset roller equipped with: a reaction liquid storage part 103*a* in which a reaction liquid is stored; and reaction liquid applying members 103*b*, 103*c* each of which can apply the reaction liquid in the reaction liquid storage part 103*a* onto the transfer body 101.

The reaction liquid applying device may be any one, as long as the reaction liquid can be applied onto an ejection object medium (i.e., a medium onto which the liquid is to be ejected), and conventionally known devices may be used appropriately. Specific examples of the device include a gravure offset roller, an inkjet head, a die coating device (a die coater) and a blade coating device (a blade coater). The application of the reaction liquid with the reaction liquid applying device may be carried out before or after the application of the ink, as long as the reaction liquid can be mixed (reacted) with the ink on the ejection object medium. It is preferred that the reaction liquid is applied before the application of the ink. When the reaction liquid is applied before the application of the ink, it becomes possible to prevent the occurrence of bleeding which is a phenomenon that adjacent ink droplets are mixed together or beading which is a phenomenon that previously-shot ink droplets are drawn to the latterly-shot ink droplets during the recording of an image by inkjet mode.

<Reaction Liquid>

The reaction liquid can agglutinate a component having an anionic group (e.g., a resin, a self-dispersing pigment) in an ink upon the contact with the ink, and contains a reactant. Examples of the reactant include a polyvalent metal ion, a cationic component such as a cationic resin, and an organic acid.

Specific examples of the polyvalent metal ion include: a bivalent metal ion such as $Ca^{2+}$, $Cu^{2+}$, $Ni^{2+}$, $Mg^{2+}$, $Sr^{2+}$, $Ba^{2+}$ and $Zn^{2+}$; and a trivalent metal ion such as $Fe^{3+}$, $Cr^{3+}$, $Y^{+}$ and $Al^{3+}$. In order to add a polyvalent metal ion to the reaction liquid, a polyvalent metal salt (which may be in the form of a hydrate) composed of a polyvalent metal ion and an anion which are bonded together can be used. Specific examples of the anion include: an inorganic anion such as $Cl^{-}$, $Br^{-}$, $I^{-}$, $ClO_2^{-}$, $ClO_3^{-}$, $ClO_4^{-}$, $NO_2^{-}$, $NO_3^{-}$, $SO_4^{2-}$, $CO_3^{2-}$, $HCO_3^{-}$, $PO_4^{3-}$, $HPO_4^{2-}$ and $H_2PO_4^{-}$; and an organic anion such as $HCOO^{-}$, $(COO^{-})_2$, $COOH(COO^{-})$, $CH_3COO^{-}$, $C_2H_4(COO^{-})_2$, $C_6H_5COO^{-}$, $C_6H_4(COO^{-})_2$ and $CH_3SO_3^{-}$. In the case where a polyvalent metal ion is used as the reactant, the content (% by mass) of the polyvalent metal ion in the reaction liquid in terms of a polyvalent metal salt content is preferably 1.00% by mass or more to 10.00% by mass or less relative to the whole mass of the reaction liquid.

Examples of the cationic resin include a resin having a primary to tertiary amine structure and a resin having a quaternary ammonium salt structure. Specific examples include resins having structures of vinylamine, allylamine, vinylimidazole, vinylpyridine, dimethylaminoethyl methacrylate, ethyleneimine and guanidine. In order to improve the solubility in the reaction liquid, the cationic resin may be combined with an acidic compound or the cationic resin may be subjected to a quaternization treatment. In the case where the cationic resin is used as the reactant, the content (% by mass) of the cationic resin in the reaction liquid is preferably 1.00% by mass or more to 10.00% by mass or less relative to the whole mass of the reaction liquid.

The reaction liquid containing an organic acid has a buffering ability in an acidic region (a pH value lower than 7.0, preferably a pH value of 2.0 to 5.0) and therefore can make anionic groups in components present in the ink acidic to agglutinate the components. Specific examples of the organic acid include: a monocarboxylic acid, such as formic acid, acetic acid, propionic acid, butyric acid, benzoic acid, glycolic acid, lactic acid, salicylic acid, pyrrole carboxylic acid, furan carboxylic acid, picolinic acid, nicotinic acid, thiophenecarboxylic acid, levulinic acid and coumaric acid, and salts thereof; a dicarboxylic acid, such as oxalic acid, malonic acid, succinic acid, glutaric acid, adipic acid, maleic acid, fumaric acid, itaconic acid, sebacic acid, phthalic acid, malic acid and tartaric acid, and salts and hydrogen salts thereof a tricarboxylic acid, such as citric acid and trimellitic acid, and salts and hydrogen salts thereof and a tetracarboxylic acid, such as pyromellitic acid, and salts and hydrogen salts thereof.

As the components other than the reactant in the reaction liquid, components which are mentioned below as the components that can be used in inks, such as water, a water-soluble organic solvent and other additives, can be used.

<Ink Applying Device>

In the present embodiment, as the ink applying device 104 for applying an ink onto the transfer body 101, a liquid ejection head can be used. The type of the liquid ejection head includes a type in which an ink is ejected by causing the film boiling of the ink by means of, for example, a thermoelectric converter to form bubbles, a type in which an ink is ejected using an electromechanical converter, and a type in which an ink is ejected utilizing static electricity. Among these types, a type using a thermoelectric converter is particularly preferably used from the viewpoint of the achievement of high-speed and high-density image recording. The formation of an image using a liquid ejection head is carried out by applying an ink in an amount required for each position in response to an image signal. The details about the liquid ejection head will be described below.

In the present embodiment, the liquid ejection head is a pagewide-type liquid ejection head which extends in the direction of the width of the recording medium 108, in which ejection orifices are arranged in a region that covers the width of an image recording region of a recording medium 108 having a usable maximum size. The liquid ejection head has, on the lower side (i.e., the side facing the transfer body 101), an ink-ejected surface into which the ejection orifices are opened, and the ink-ejected surface faces the surface of the transfer body 101 with small gaps (about several millimeters) apart therebetween.

The amount of the ink to be applied is expressed in an image density (Duty) or an ink thickness. In the present embodiment, the amount of the ink is defined as an average value ($g/m^2$) which is obtained by multiplying the mass of each ink dot by the number of dots to be applied and then dividing the resultant value by a printing area. From the viewpoint of the removal of the liquid component from the ink, the term "maximum ink application amount in an image region" as used herein refers to the amount of the ink applied onto an area having a size of at least 5 $mm^2$ or more in an region that is used as the information for the ejection object medium.

The ink applying device 104 may have a plurality of liquid ejection heads for the purpose of applying various color inks onto the ejection object medium. For example, in the case where it is intended to form a color image using a yellow ink, a magenta ink, a cyan ink and a black ink, the ink applying device 104 has four liquid ejection heads for separately ejecting the four inks onto the ejection object medium. In this case, these liquid ejection heads are arranged along the direction of the movement of the transfer body 101. The configuration of the liquid ejection heads is not limited to this configuration, and the ink applying device 104 may have a color-integrated pagewide-type liquid ejection head which can eject a plurality of kinds of inks through a single liquid ejection head.

Alternatively, the ink applying device 104 may be equipped with a liquid ejection head which can eject a substantially transparent clear ink containing no coloring material or containing a very small amount of a coloring material. The clear ink can be used together with the reaction liquid and the color ink to form an ink image. In this case, glossiness of the image, for example, can be improved. It is preferred to adjust the amount of the resin component to be added appropriately and control the ejection position for the clear ink in such a manner that an image after transfer has glossiness. The clear ink is desirably positioned on the surface layer side relative to the color ink in a final recorded matter, and therefore it is preferred to apply the clear ink onto the transfer body 101 before the application of the color ink. For this reason, it is preferred that the liquid ejection head for a clear ink is placed on the upstream side relative to the liquid ejection head for a color ink as observed in the direction as observed in the direction of the movement of the transfer body 101.

For other purpose than for the application of glossiness, a clear ink can be used for improving the transfer properties of an image from the transfer body 101 onto the recording medium 108. For example, it is possible to add a component capable of exhibiting higher adhesiveness than a color ink in a larger amount to the clear ink and apply the resultant clear ink onto the color ink. In this manner, the clear ink can be used as an agent for improving the transfer properties to be imparted to the transfer body 101. For example, a liquid ejection head for a transfer properties-improving clear ink is placed on the downstream side from the liquid ejection head for a color ink as observed in the direction of the movement of the transfer body 101. The color ink is applied onto the transfer body 101, and then the clear ink is applied onto the transfer body 101. As a result, the clear ink can exist in the outermost surface of the ink image. In the transfer of the ink image from the transfer body 101 to the recording medium 108, the clear ink on the surface of the ink image adheres to the recording medium 108 with a certain degree of adhesion force, and therefore the ink image after the removal of the liquid can move toward the recording medium 108 more easily.

<Ink>

Hereinbelow, components for an ink to be used in the present embodiment will be described.

(Coloring Material)

As the coloring material to be contained in an ink used in the present embodiment, a pigment or a dye can be used. The content of the coloring material in the ink is preferably 0.5% by mass or more to 15.0% by mass or less, more preferably 1.0% by mass or more to 10.0% by mass or less, relative to the whole mass of the ink.

The type of the pigment that can be used as the coloring material is not particularly limited. Specific examples of the pigment include: an inorganic pigment such as carbon black and titanium oxide; and an organic pigment such as those of an azo-based, a phthalocyanine-based, a quinacridone-based, an isoindolinone-based, an imidazolone-based, a diketopyrrolopyrrole-based and a dioxazine-based. These pigments may be used singly or two or more of them may be used in combination as required. The type of the dispersion of the pigment is not particularly limited, either. For example, a resin-dispersed pigment which is dispersed with a resin dispersant, and a self-dispersing pigment in which a hydrophilic group (e.g., an anionic group) is bonded to the surface of each particle of a pigment directly or through another atomic group can be used. Of course, a combination of pigments having different dispersion forms can also be used.

As the resin dispersant for dispersing the pigment, any known resin dispersant which can be used for a water-based inkjet ink can be used. Particularly in one example of the present embodiment, an acrylic water-soluble resin dispersant having a hydrophilic unit and a hydrophobic unit in a molecular chain can be used preferably. Examples of the form of the resin include a block copolymer, a random copolymer, a graft copolymer, and a combination thereof.

The resin dispersant in the ink may be dissolved in a liquid medium or may be dispersed as resin particles in a liquid medium. The wording "the resin is water-soluble" as used herein means that, when the resin is neutralized with an alkali in an amount equivalent to the acid value of the resin, no particle of which the particle diameter can be measured by a dynamic light scattering is formed.

The hydrophilic unit (a unit having a hydrophilic group such as an anionic group) can be formed by, for example, polymerizing a monomer having a hydrophilic group. Specific examples of the monomer having a hydrophilic group include anionic monomers including an acidic monomer having an anionic group, e.g., (meth)acrylic acid and maleic acid, and an anhydride or a salt of the acidic monomer. Examples of the cation constituting a salt of the acidic monomer include ions of lithium, sodium, potassium, ammonium and organic ammonium.

The hydrophobic unit (a unit that does not have hydrophilicity, such as an anionic group) can be formed by, for example, polymerizing a monomer having a hydrophobic group. Specific examples of the monomer having a hydrophobic group include: a monomer having an aromatic ring, such as styrene, α-methylstyrene and benzyl (meth)acrylate; and a monomer having an aliphatic group (i.e., a (meth) acrylic ester monomer), such as ethyl (meth)acrylate, methyl (meth)acrylate and butyl (meth)acrylate.

The acid value of the resin dispersant is preferably 50 mgKOH/g or more to 550 mgKOH/g or less, more preferably 100 mgKOH/g or more to 250 mgKOH/g or less. The weight average molecular weight of the resin dispersant is preferably 1,000 or more to 50,000 or less. The content (% by mass) of the pigment is preferably 0.3 time or more to 10.0 times or less the content of the resin dispersant, in term of a (pigment/resin dispersant) ratio by mass.

As the self-dispersing pigment, a self-dispersing pigment in which an anionic group such as a carboxylic acid group, a sulfonic acid group and a phosphonic acid group is bonded to the surface of each particle of a pigment directly or through another atomic group (—R—) can be used. The anionic group may be in an acid form or a salt form. When the anionic group is in a salt form, a portion thereof may be dissociated or the whole thereof may be dissociated. Examples of the cation that is a counter ion in the case where the anionic group is in a salt form include an alkali metal cation, ammonium and organic ammonium. Specific examples of the above-mentioned another atomic group (—R—) include: a linear or branched alkylene group having 1 to 12 carbon atoms; an arylene group such as a phenylene group and a naphthylene group; an amide group; a sulfonyl group; an amino group; an carbonyl group; an ester group; and an ether group. A group which is a combination of these groups may also be used.

The type of the dye that can be used as the coloring material is not particularly limited, and a dye having an anionic group can be used preferably. Specific examples of the dye include dyes of an azo-based, a triphenylmethane-based, an (aza)phthalocyanine-based, a xanthene-based and an anthrapyridone-based. These dyes may be used singly, or two or more of them may be used in combination.

In the present embodiment, it is also preferred to use, without use of dispersant, a so-called self-dispersing pigment which is a pigment of which the surface is modified so as to become dissolvable.

(Resin Particles)

The ink to be used in the present embodiment can contain resin particles. The resin particles are not needed to contain a coloring material. The resin particles are effective for the improvement of image quality and fixability and therefore are preferable.

The material for the resin particles to be used in the present embodiment is not particularly limited, and any known resin can be used appropriately. Specific examples of the resin particles include resin particles made from various materials including an olefin-based material, a polystyrene-based material, a urethane-based material and an acrylic material. The weight average molecular weight (Mw) of the resin particles is preferably within the range from 1,000 or more to 2,000,000 or less. The volume average particle diameter of the resin particles as measured by a dynamic light scattering method is preferably 10 nm or more to 1,000 nm or less, more preferably 100 nm or more to 500 nm or less. The content (% by mass) of the resin particles in the ink is preferably 1.0% by mass or more to 50.0% by mass or less, more preferably 2.0% by mass or more to 40.0% by mass or less, relative to the whole mass of the ink.

In particular, it is preferred that the ink that can be used in the present embodiment contains a film-forming component having a minimum film-forming temperature (MFT) of 100° C. or higher. As the film-forming component, wax particles are preferably contained in addition to the resin particles. When wax particles are contained, it is expected that the film formation proceeds rapidly and transfer properties are improved when the ink image is heated to a temperature higher than the MFT.

The component for the wax particles includes, for example, a natural wax or a synthetic wax. Examples of the natural wax include a petroleum-based wax, a plant-derived wax and an animal-derived wax. Specific examples of the petroleum-based wax include a paraffin wax, a microcrystalline wax and a petrolatum. Specific examples of the plant-derived wax include carnauba wax, candelilla wax, rice wax and Japan wax. Specific examples of the animal-derived wax include lanolin and bees wax. Specific examples of the synthetic wax include a synthetic hydrocarbon-based wax and a modified wax. Specific examples of the synthetic hydrocarbon-based wax include polyethylene wax and Fischer-Tropsch wax. Specific examples of the modified wax include a paraffin wax derivative, a montan wax derivative and a microcrystalline wax derivative. These waxes may be used singly, or two or more of them may be used in combination.

It is preferred to add the wax particles to the ink in the form of a wax particle dispersion prepared by dispersing the wax particles in a liquid. The wax particles are preferably formed by dispersing a wax component with a dispersant. The dispersant is not particularly limited, and any known dispersant can be used. It is preferred to select the dispersant with taking the stability of the dispersed state in the ink into consideration.

The average particle diameter (number-size 90% particle diameter) of the wax particles is preferably 1 μm or less from the viewpoint of the dischargeablity of the ink in an inkjet mode.

(Aqueous Medium)

In the ink that can be used in the present embodiment, water may be added, or an aqueous medium that is a solvent mixture of water and a water-soluble organic solvent may be added. As water, deionized water or ion-exchanged water is preferred. The content (% by mass) of water in the water-based ink is preferably 50.0% by mass or more to 95.0% by mass or less relative to the whole mass of the ink. The content (% by mass) of the water-soluble organic solvent in the water-based ink is preferably 3.0% by mass or more to 50.0% by mass or less relative to the whole mass of the ink. As the water-soluble organic solvent, any one such as an alcohol, a (poly)alkylene glycol, a glycol ether, a nitrogenated compound and a sulfur-containing compound may be used as long as the organic solvent can be used in an inkjet ink. The solvents may be used singly, or two or more of them may be used in combination.

(Other Additives)

In the ink that can be used in the present embodiment, in addition to the above-mentioned components, various additives may be used as required, such as an antifoaming agent, a surfactant, a pH-adjusting agent, a viscosity modifier, an anti-corrosive agent, a preservative agent, an anti-mold agent, an antioxidant agent, a reduction-preventing agent and a water-soluble resin.

<Liquid Absorbing Device>

The liquid absorbing device 105 in the present embodiment is equipped with: a liquid absorbing member 105*a*; and a pressing member 105*b* for liquid absorption purposes, which is for pressing the liquid absorbing member 105*a* against the ink image on the transfer body 101. The shape of each of the liquid absorbing member 105*a* and the pressing member 105*b* is not particularly limited. For example, as shown in FIG. 1, the liquid absorbing device 105 has a configuration such that the pressing member 105*b* has a columnar form and the liquid absorbing member 105*a* has a belt-like form, wherein the belt-like liquid absorbing member 105*a* is pressed against the transfer body 101 by means of the columnar pressing member 105*b*. Alternatively, the liquid absorbing device 105 has a configuration such that the pressing member 105*b* has a columnar form and the liquid absorbing member 105*a* has a cylindrical form formed on the peripheral surface of the columnar pressing member 105*b*, wherein the cylindrical liquid absorbing member 105*a* is pressed against the transfer body by means of the columnar pressing member 105*b*. In the present embodiment, it is preferred that the liquid absorbing member 105*a* has a belt-like shape as shown in the drawing, from the viewpoint of a space in the inkjet recording device 1000.

The liquid absorbing device 105 equipped with the belt-like liquid absorbing member 105*a* may have an extending member for extending the liquid absorbing member 105*a*. In FIG. 1, extend rollers 105*c* to 105*e* are shown as the extending members. In FIG. 1, although a pressing member 105*b* is also shown as a rotating roller member like the extend rollers 105*c* to 105*e*, it is not limited to such a configuration.

In the liquid absorbing device 105, the liquid component contained in the ink image is absorbed by the liquid absorbing member 105*a* and is decreased by pressing the liquid absorbing member 105*a* equipped with a porous body against the ink image by means of the pressing member 105*b* to allow the liquid absorbing member 105*a* to contact with the ink image. As the method for decreasing the liquid component in the ink image, a method in which the liquid absorbing member 105*a* is brought into contact with the ink image, as well as a combination of various conventionally employed methods, e.g., a method utilizing heating, a method in which low-humidity air is brown, and a method in which the pressure is reduced, may be employed. Alternatively, the liquid-removed ink image from which the liquid component has been decreased may be subjected to any one of the above-mentioned methods to further decrease the liquid component.

<Liquid Absorbing Member>

In the present embodiment, at least a portion of the liquid component contained in the liquid-unremoved ink image is brought into contact with the liquid absorbing member 105*a* equipped with a porous body to cause the absorption and removal of the portion of the liquid component, thereby decreasing the content of the liquid component in the ink image. When a surface of the liquid absorbing member 105*a* on which the ink image is contacted is defined as a first surface, the porous body is arranged on the first surface.

It is preferred that the liquid absorbing member equipped with the porous body has a shape such that the liquid absorbing member can move along with the movement of the ejection object medium and can absorb a liquid while circulating so as to contact with an ink image and then contact with another liquid-unmoved ink image again at a predetermined frequency. Examples of the shape include an endless belt-like shape and a drum-like shape.

(Porous Body)

As the porous body to be used in the liquid absorbing member 105*a* in the present embodiment, a porous body in which the average pore diameter on the first surface side is smaller than that on the side of a second surface that faces the first surface is preferably used. For the purpose of preventing the adhesion of a coloring material in the ink onto the porous body, it is preferred that the pore diameters are smaller and the average pore diameter of the porous body on the first surface side on which at least the ink image is contacted is 10 μm or less. The term "average pore diameter" as used herein refers to an average diameter of pores on the first surface or the second surface, and can be determined by any known technique including a mercury intrusion method, a nitrogen adsorption method and SEM image observation.

Furthermore, in order to achieve uniform and high air permeability, it is preferred that the thickness of the porous body is small. The air permeability can be expressed in a Gurley value defined in accordance with JIS P8117. In the present embodiment, the Gurley value is equal to or less than 10 seconds. If the thickness of the porous body is reduced, a capacity needed for the absorption of the liquid component may not be secured satisfactorily. Therefore, the porous body may have a multilayer structure. The liquid absorbing member 105*a* may be any one, as long as a layer that contacts with the ink image is made from a porous material, wherein a layer that does not contact with the ink image may not be formed from a porous material.

Hereinbelow, the structure of each layer in a porous body having a multilayer structure and the method for producing the porous body will be described. In the following statements, a layer that is located on the ink image-contacting side is defined as a first layer and a layer that is laminated on a surface opposed to a surface that contact the ink image on the first layer is defined as a second layer.

[First Layer]

In the present embodiment, the material for the first layer is not particularly limited, and either one of a hydrophilic material having a water contact angle of less than 90° and a water-repellent material having a water contact angle of 90° or more can be used. In the case where a hydrophilic material is used, it is preferred to select the hydrophilic material from a single-component material such as cellulose and polyacrylamide, a composite material thereof and the like. Alternatively, a material produced by hydrophilizing the surface of a water-repellent material as mentioned below may be used. For the hydrophilization treatment, a sputter etching method, a radioactive ray or $H_2O$ ion radiation method, an excimer (ultraviolet ray) laser beam radiation method and the like can be employed. In the case where a hydrophilic material is used, it is more preferred to use a hydrophilic material having a water contact angle of 60° or less. The use of a hydrophilic material has an effect such that a liquid, particularly water, can be soaked up by the action of a capillary force.

On the other hand, from the viewpoint of the prevention of adhesion of the coloring material and the improvement of cleaning performance, it is preferred to use a water-repellent material having a low surface free energy, particularly a fluororesin, as the material for the first layer. Specific examples of the fluororesin include polytetrafluoroethylene (PTFE), polychlorotrifluoroethylene (PCTFE), poly(vinylidene fluoride) (PVDF), poly(vinyl fluoride) (PVF) and perfluoroalkoxy fluororesin (PFA), and further include a tetrafluoroethylene-hexafluoropropylene copolymer (FEP), an ethylene-tetrafluoroethylene copolymer (ETFE) and an ethylene-chlorotrifluoroethylene copolymer (ECTFE). These resins may be used singly or two or more of them may be used in combination, as required. The first layer may have a laminate structure formed from a plurality of films. In the case where a water-repellent material is used, there is substantially no effect to soak up by a liquid by the action of a capillary force, and a time may be required for the soaking up of a liquid upon the first contact with the ink image. Therefore, it is preferred to impregnate the first layer with a liquid having a contact angle of the first layer of less than 90°. The liquid can be penetrated through the first layer by applying the liquid onto the first layer from the first surface side of the liquid absorbing member 105*a*. The liquid is preferably prepared by mixing water with a surfactant or a liquid having a low contact angle of the first layer.

In the present embodiment, the thickness of the first layer is preferably 50 μm or less, more preferably 30 μm or less. The thickness can be determined by measuring the thickness at arbitrary 10 positions with, for example, a linear advance-type micrometer (e.g., OMV-25, manufactured by Mitutoyo Corporation) and calculating the thickness from an average value of the measured thickness values.

The first layer can be produced by any known thin porous film production method. For example, the first layer can be produced by forming a sheet-like article from a resin material by extrusion molding or the like and then extending the sheet-like article to a predetermined thickness. Alternatively, the first layer can be produced in the form of a porous film by adding a plasticizer such as paraffin to a material during extrusion molding and then removing the plasticizer by heating or the like during the elongation. The pore diameter can be adjusted appropriately by properly adjusting the amount of the plasticizer to be added and the draw ratio of the draw ratio or the like.

[Second Layer]

In the present embodiment, the second layer is preferably a layer having air permeability. The layer may be a non-woven or woven fabric of resin fibers. The material for the second layer is not particularly limited, and is preferably a material having a liquid contact angle that is equal to or lower than that of the first layer so that the absorbed liquid cannot be regurgitated toward the first layer side. More specifically, the material is preferably selected from a single-component material such as a polyolefin (e.g., polyethylene, polypropylene), a polyamide (e.g., polyurethane, nylon), a polyester (e.g., poly(ethylene terephthalate)) and polysulfone, and a composite material thereof. The second layer is preferably a layer having larger pore diameters than those in the first layer.

[Third Layer]

In the present embodiment, the number of layers in the porous body having a multilayer structure is not particularly limited, and may be three or more. From the viewpoint of stiffness, a third layer (also referred to as a "3rd layer") or a subsequent layer is preferably a non-woven fabric. As the material for the layer, the same material as that used for the second layer can be used.

[Other Materials]

The liquid absorbing member 105*a* may have a reinforcing member for reinforcing a side surface of the liquid absorbing member 105*a*, in addition to the above-mentioned porous body. The liquid absorbing member 105*a* may also have a bonding member that is used for bonding length-direction ends of a long sheet-like porous body to each other to form a belt-like member. As the material for the bonding member, a non-porous tape material can be used, and may be arranged at a position at which the ink image does not contact or may be arranged at regular intervals.

[Method for Producing Porous Body]

The method for forming the porous body by laminating the first layer and the second layer together is not particularly limited, and these layers may be superposed on each other or may be bonded together by the lamination by an adhesive agent, the lamination by heating or the like. In the present embodiment, from the viewpoint of air permeability, it is preferred to employ lamination by heating. Alternatively, for example, it is possible to melt a portion of the first layer or the second layer by heating and then bonding the first layer and the second layer to each other. Alternatively, it also possible to interpose a melting material, e.g., a hot-melt powder, between the first layer and the second layer and then heating the melting material to bond the first layer and the second layer to each other. In the case where the porous body is composed of three or more layers, these layers may be laminated at a time or sequentially. In this case, the order of lamination can be selected appropriately.

In the heating step, a lamination method in which the porous body is heated with a heated roller while sandwiching the porous body by the heated roller while applying a pressure is preferred.

<Various Requirements for Liquid Absorbing Device, and Configuration of Liquid Absorbing Device>

In the present embodiment, it is preferred to subject the liquid absorbing member 105*a* equipped with the porous body to a pretreatment by means of a pretreatment means (not shown) for applying a treatment solution to the liquid absorbing member 105*a*, prior to allowing the liquid absorbing member 105*a* to contact with the ink image. The treatment solution to be used in the present embodiment preferably contains water and a water-soluble organic solvent. The water is preferably water that is deionized by ion exchange or the like. The type of the water-soluble organic solvent is not particularly limited, and any known organic solvent, e.g., ethanol and isopropyl alcohol, can be used. In the pretreatment of the liquid absorbing member 105*a* to be carried out in the present embodiment, the method for applying the treatment solution is not particularly limited, and is preferably a method in which the treatment solution is applied by dipping or a method in which the treatment solution is applied by dropwise addition.

The pressure in the liquid absorbing member 105*a* upon the contacting with the ink image on the transfer body 101 is preferably 2.9 $N/cm^2$ (0.3 $kgf/cm^2$) or more. In this case, it becomes possible to remove the liquid component in the ink image by solid/liquid separation within a short time. The term "the pressure in the liquid absorbing member" as used herein refers to a nip pressure between the ejection object medium and the liquid absorbing member, and can be determined by measuring a surface pressure using a surface pressure distribution measurement device (e.g., I-SCAN manufactured by Nitta Corporation) and then dividing the load in a pressurized region by the area.

The working time for bringing the liquid absorbing member 105*a* into contact with the ink image is preferably 50 ms or shorter, in order to prevent the adhesion of the coloring material in the ink image onto the liquid absorbing member 105*a*. The working time can be calculated by dividing a pressure sensing width in the direction of the movement of the ejection object medium in the above-mentioned surface pressure by the moving speed of the ejection object medium.

<Pressing Member and Heating Unit>

The ink image on the transfer body 101 (in which the liquid component has been decreased by the liquid absorbing device 105) contacts with and is transferred onto a recording medium 108 (which is conveyed by a recording medium conveyance device 107) by means of a pressing member 106 that serves as a transfer part. In the present embodiment, the transfer of the ink image onto the recording medium 108 is performed after the removal of the liquid component contained in the ink image, and consequently a recording image free of curling, cockling or the like can be obtained.

In the pressing member 106, from the viewpoint of the accuracy of conveyance of the recording medium 108 and durability, a certain level of structural strength is required. As the material for the pressing member 106, a metal, a ceramic, a resin and the like can be used preferably. In particular, for the purpose of improving stiffness required for withstanding the pressurization upon transfer and dimensional accuracy and reducing the inertia during operation to improve control responsiveness, the following materials are used preferably: aluminum, iron, stainless steel, an acetal resin, an epoxy resin, polyimide, polyethylene, poly(ethylene terephthalate), nylon, polyurethane, silica ceramic and alumina ceramic. These materials may be used in combination. The shape of the pressing member 106 is not particularly limited, and a roller-like shape can be mentioned as an example.

The pressing time for pressing the transfer body 101 by the pressing member 106 for the purpose of transferring the ink image on the transfer body 101 onto the recording medium 108 is not particularly limited. In order to achieve the transfer satisfactorily and avoid the impairment of the durability of the transfer body 101, the pressing time is preferably 5 ms or longer to 100 ms or shorter. The term "pressing time" as used herein refers to a time during which the recording medium 108 and the transfer body 101 contact with each other, and can be calculated by measuring a surface pressure using a surface pressure distribution measurement device (e.g., I-SCAN manufactured by Nitta Corporation) and then dividing the length of a pressurized region in the conveyance direction by the conveyance speed.

The pressure required for pressing the transfer body 101 by the pressing member 106 is not particularly limited, either. It is required to achieve the transfer satisfactorily and avoid the impairment of the durability of the transfer body 101. For these reasons, the pressure is preferably 9.8 $N/cm^2$ (1 $kg/cm^2$) or more to 294.2 $N/cm^2$ (30 $kg/cm^2$) or less. The term "pressure" as used herein refers to a nip pressure between the recording medium 108 and the transfer body 101, and can be calculated by measuring a surface pressure using a surface pressure distribution measurement device and then dividing the load in a pressurized region by the area.

In the present embodiment, the liquid-removed ink image on the transfer body 101 is heated with the heating unit 110 to a temperature equal to or higher than the minimum film-forming temperature (MFT) of the film-forming component (e.g., resin particles) contained in the ink and is then transferred onto the recording medium 108. When the ink image is heated to a temperature equal to or higher than the MFT, it is expected as follows: the resin particles and the like in the ink image are melted on the transfer body 101 and then the ink image contacts with the recording medium 108 having a lower temperature, and consequently the adhesion between the ink image and the recording medium 108 is improved, and therefore the transfer can be achieved satisfactorily. It is important that the MFT of the film-forming component in the ink image is 100° C. or higher, from the viewpoint of obtaining an image having excellent robustness. In the present embodiment, the temperature of heating the ink image is preferably higher by 10° C. or more than the MFT, more preferably higher by 20° C. or more than the MFT, from the viewpoint of the transfer properties and robustness of the image. As the heating unit 110, any known method can be employed, such as heating by irradiation with a lamp (e.g., an infrared ray lamp) or heating with a hot air fan. In particular, it is preferred to use an infrared ray heater because of its high heating efficiency. As shown in the drawing, it is preferred that the heating unit 110 is arranged on the downstream side from the ink applying device 104 and on the upstream side from the pressing member 106 as observed in the direction of the rotation of the transfer body 101.

The minimum film-forming temperature (MFT) can be determined by a conventionally known technique, for example, using a device in accordance with JIS K6828-2: 2003 or ISO2115:1996. In the present embodiment, the MFT is evaluated using the above-mentioned device after the ink is dried at ambient temperature.

<Cooling Unit>

In the present embodiment, the application of the ink, the absorption of the liquid and the transfer are carried out repeatedly. Therefore, it is preferred to cool the transfer body 101 after the transfer of the ink image. When the transfer body 101 is cooled at a high speed, it becomes possible to prevent the volatilization of the liquid component from the ink image on the transfer body 101 during a period after the next application of the ink with the ink applying device 104 and until the liquid is absorbed with the liquid absorbing device 105. This cooling is preferably carried out at the timing of the liquid absorption until the temperature becomes lower than the boiling point of water that is the main solvent of the ink, and is more preferably carried out at the timing of the application of the ink until the temperature becomes lower than the boiling point of water.

Figure 3:
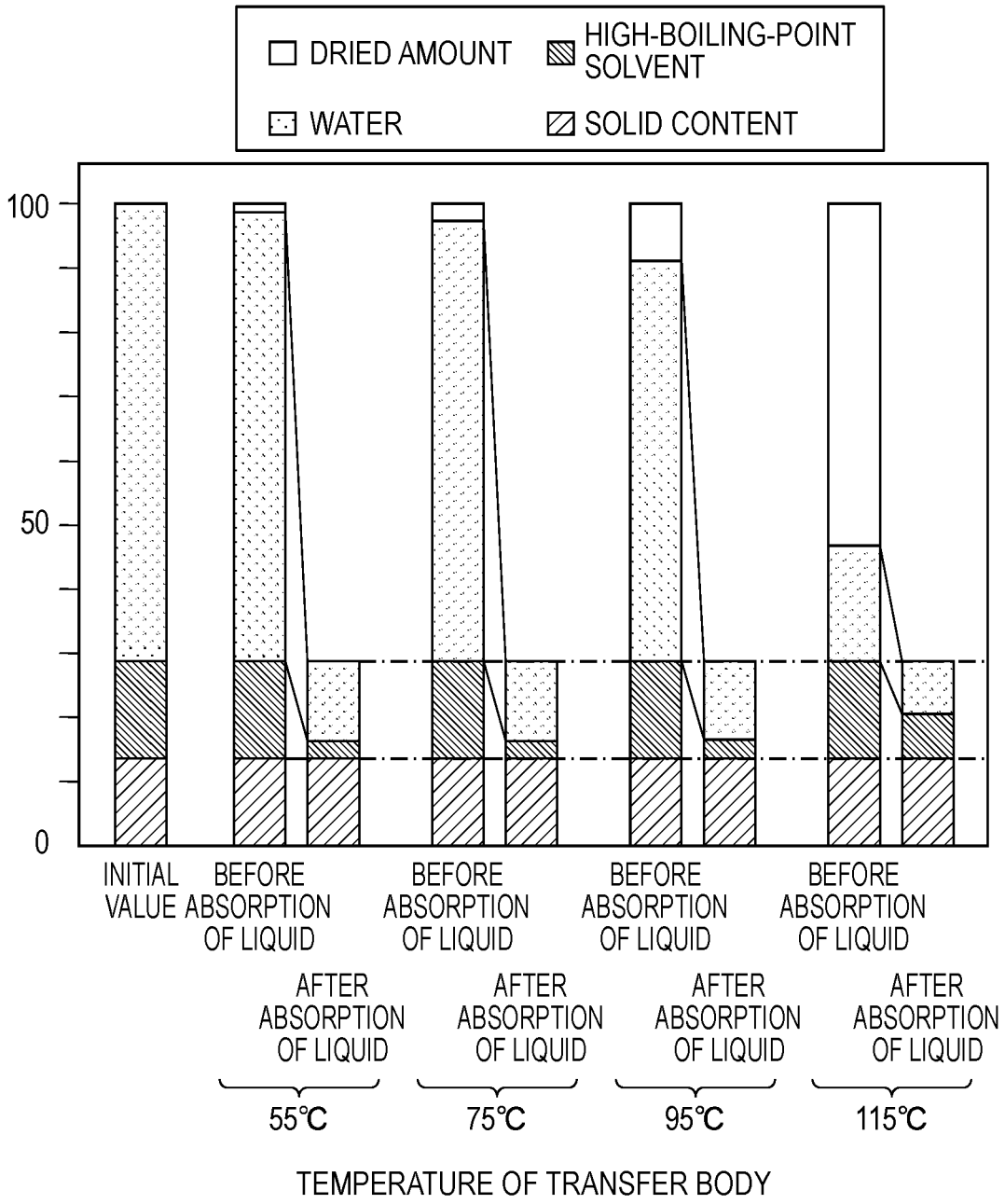
FIG. 3 is a graph illustrating the change in composition of an ink image before and after the absorption of a liquid.

FIG. 3 is a graph illustrating the change in the composition of the ink image before and after the absorption of the liquid with the change in the temperature of the transfer body 101. As shown in this graph, it is found that the amount of water dried after the formation of an ink image having a solid content of about 13%, a high-boiling-point solvent content of about 15% with the remainder made up by water as initial values and before the absorption of liquid varies depending on the temperature of the transfer body 101. In particular, it is found that, when the temperature of the transfer body 101 is equal to or higher than 100° C. that is the boiling point of water, the dried amount of water before the absorption of liquid is increased compared with those at other temperatures. In the liquid absorption using a porous body, a certain amount of a liquid remains in the ink image regardless of the temperature of the transfer body 101. In other words, the liquid component can be absorbed uniformly by the liquid absorption process, and therefore the composition of the liquid component in the ink image after the absorption of liquid depends on the volatilized water before the absorption of liquid. The water in the ink image is volatilized during the transfer process, while the high-boiling-point solvent is not volatilized and remains in the transferred image, resulting in the deterioration in robustness of the image. For these reasons, it is preferred to cool the transfer body 101 after the transfer of the ink image to a temperature that is lower than the boiling point of water that is the main solvent of the ink, as mentioned above.

On the other hand, the transfer properties of the image depend on the transfer temperature. When an ink having a low MFT is used in an inkjet recording mode using a water-based ink, the transfer does not have to be carried out at a high temperature, and therefore the liquid removal in combination with drying cannot be sometimes achieved satisfactory in the transfer process. With respect to an ink having a low MFT, even if the transfer is carried out at a high temperature, the robustness of the image itself is decreased compared with the case where an ink having a high MFT is used. From these viewpoints, it is advantageous to carry out the transfer at a high temperature using an ink having a high MFT.

As the cooling method, any known method can be employed, such as a method in which cold air is brown, a method in which a cooled roller is contacted, and a method in which a vaporization heat is utilized. Particularly for cooling rapidly, it is preferred to employ a method in which a solid or a liquid is brought into contact with the transfer body 101, and it is also preferred to combine this method with the blowing of air or the like. As the method for bringing a liquid into contact, the liquid may be applied directly or a porous body impregnated with the liquid may be contacted.

When the liquid absorbing member 105*a* is cooled, the volatilization of the liquid component in the ink image can be prevented more reliably and absorption failures can be reduced even in the liquid absorption process.

<Cleaning Member>

In the present embodiment, a cleaning member 109 may be provided, which can clean the ink remaining on the transfer body 101 after the transfer of the ink image or a paper powder that is reversely transferred from the recording medium 108. As the cleaning method, any know method may be employed appropriately, such as a method in which a porous member is contacted, a method in which scrubbing is carried out with a brush, and a method in which scraping out is carried out with a blade. The shape of the cleaning member may be any known shape, such as a web-like shape, in addition to the roller-like shape shown in the drawing.

In the present embodiment, it is also preferred to cool the cleaning member 109 and use the cooled cleaning member 109 as the above-mentioned cooling unit.

<Recording Medium and Recording Medium Conveyance Device>

In the present embodiment, the recording medium 108 is not particularly limited, and any known recording medium can be used. The recording medium may be a long material that is wound into a roll-like shape, a sheet that is cut into a given size, and the like. Examples of the material for the recording medium include paper, a plastic film, a wood board, a cardboard and a metal film.

In FIG. 1, the recording medium conveyance device 107 for conveying the recording medium 108 is composed of a recording medium feeding roller 107*a* and recording medium winding roller 107*b*. The configuration of the recording medium conveyance device 107 is not particularly limited to this configuration, as long as the recording medium can be conveyed.

<Control System>

Figure 4:
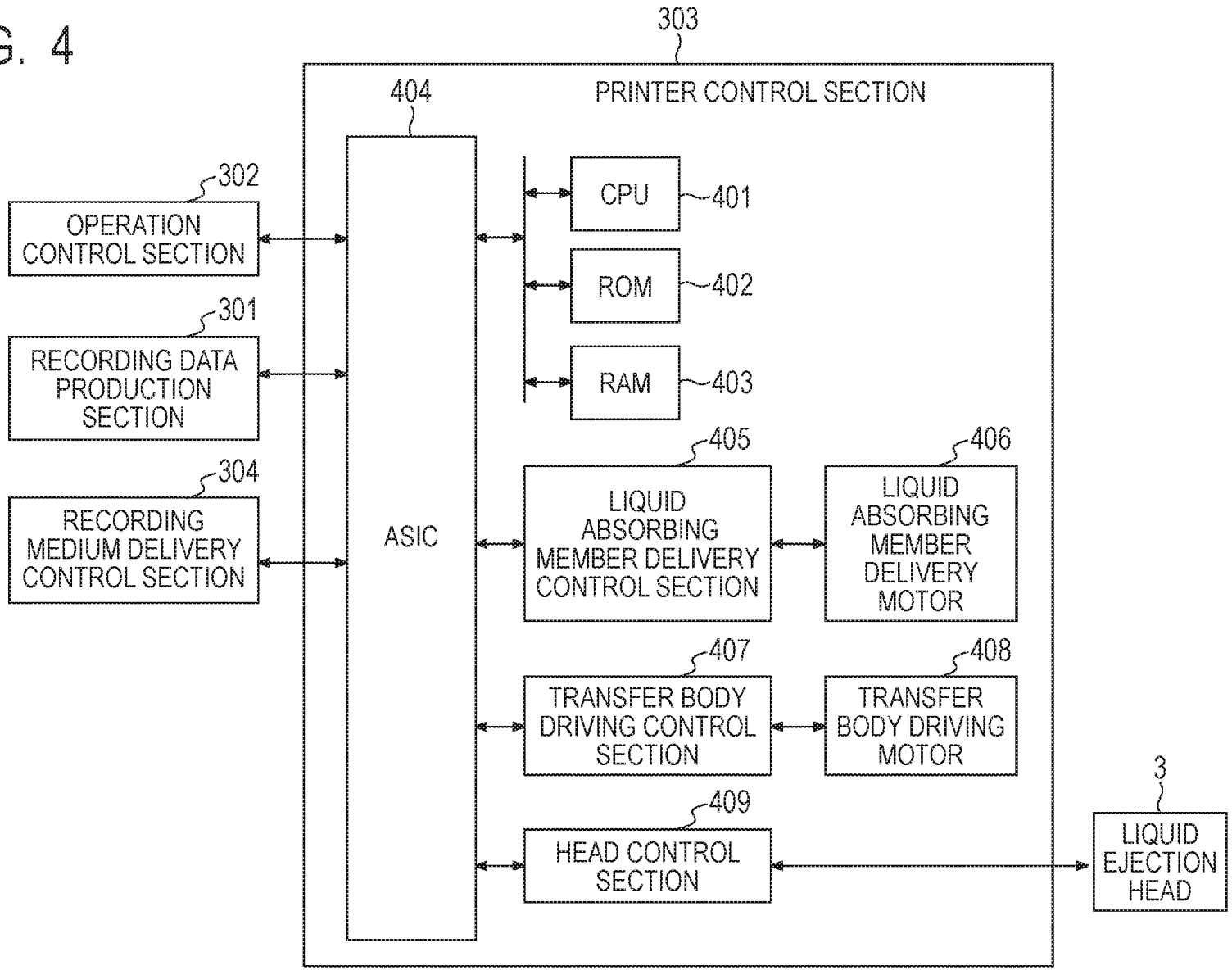
FIG. 4 is a block diagram illustrating a control system for a transfer-type inkjet recording device.

FIG. 4 is a block diagram illustrating a control system in the transfer-type inkjet recording device according to the present embodiment.

The inkjet recording device 1000 is equipped with: a recording data production section 301 such as an external print server; an operation control section 302 such as an operation panel; a printer control section 303 for conducting a recording process; and a recording medium conveyance control section 304 for conveying a recording medium.

The printer control section 303 is equipped with a CPU 401, a ROM 402, a RAM 403, an application specific integrated circuit (ASIC) 404, a liquid absorbing member conveyance control section 405, a transfer body driving control section 407 and a head control section 409. The CPU 401 controls the entirety of the device, the ROM 402 stores a control program for the CPU 401, and the RAM 403 executes the program. The ASIC 404 contains a network controller, a serial IF controller, a head data production controller, a motor controller and the like. The liquid absorbing member conveyance control section 405 drives a liquid absorbing member conveyance motor 406, and is command-controlled from the ASIC 404 through a serial IF. The transfer body driving control section 407 drives a transfer body driving motor 408, and is also command-controlled from the ASIC 404 through the serial IF. The head control section 409 conducts the production of data of final ejection for the liquid ejection head 3, the production of a driving voltage and the like.

<Liquid Ejection Head>

Hereinbelow, the liquid ejection head in the present embodiment, which constitutes the ink applying device 104, will be described. The following description is not intended to limit the scope of the present disclosure. In the present embodiment, a liquid ejection head of a thermal mode, in which a liquid is ejected by heating the liquid with a heat-generating element to generate bubbles, is employed as one example. The present disclosure can be applied to liquid ejection heads utilizing a piezo mode using a piezoelectric element and other various liquid ejection modes.

The present embodiment has a configuration that a liquid such as an ink is circulated between a tank and the liquid ejection head, and other configurations may also be employed. For example, a configuration that an ink is not circulated, two tanks are arranged respectively on the upstream side and the downstream side from the liquid ejection head and the ink is allowed to flow from one of the tanks into the other to make the ink in the pressure chamber flow, may also be employed.

(Basic Configuration)

Figure 9:
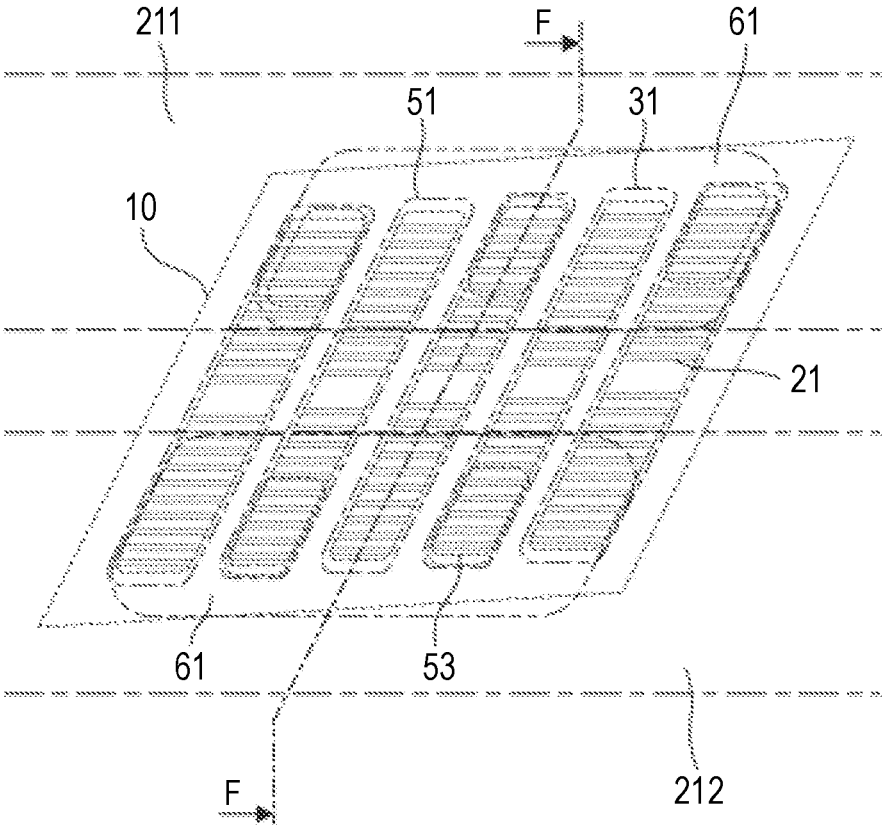
FIG. 9 is an enlarged transparent view of a part of a flow path member in the present embodiment.

In the liquid ejection head according to the present embodiment, the number of ejection orifice rows that can be used for one color is 20 (see FIG. 9). Therefore, the recording data is distributed into the plurality of ejection orifice rows appropriately upon recording, whereby vary high-speed recording becomes possible. Furthermore, even if there are ejection orifices that become unejectable, the ejection can be performed complementarily through ejection orifices in other rows located at positions corresponding to the unejectable ejection orifices as observed in the direction of the conveyance of the ejection object medium to improve reliability. Therefore, the present embodiment is suitable for commercial printing.

(Description of Circulation Pathway)

Figure 5:
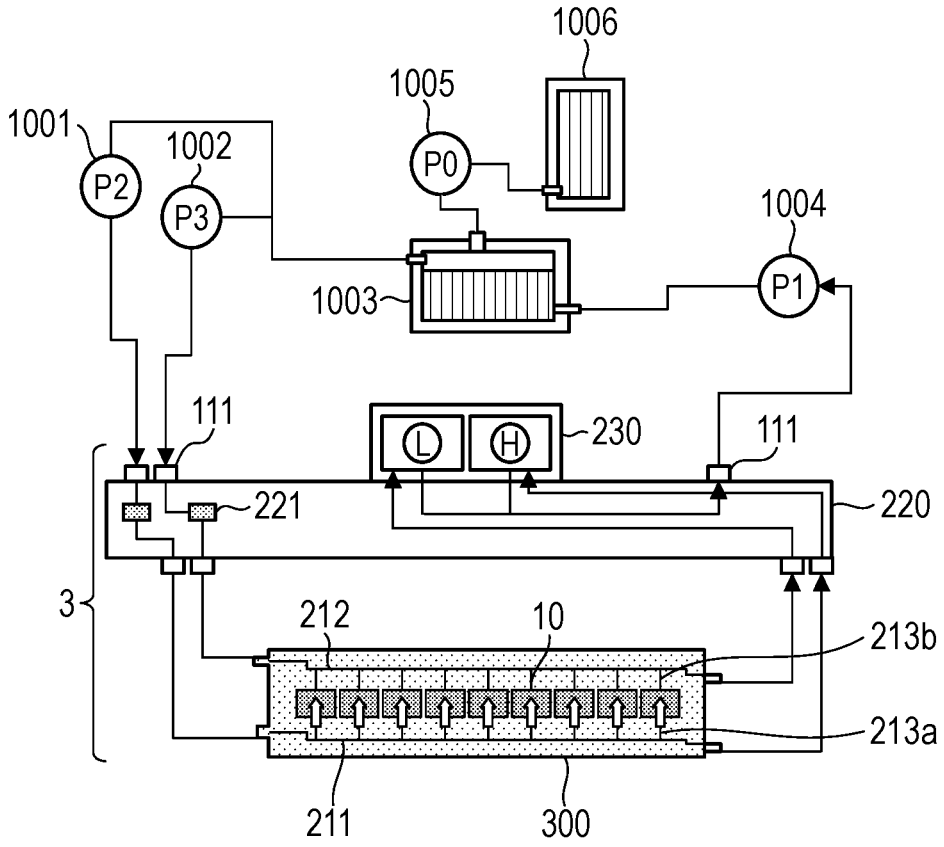
FIG. 5 is a schematic diagram illustrating an ink circulation pathway in the present embodiment.

FIG. 5 is a schematic diagram illustrating a circulation pathway that can be applied to the inkjet recording device of the present embodiment. Both of two pressure adjusting mechanisms constituting a negative pressure control unit 230 are mechanisms which can control the pressure on the upstream side from the negative pressure control unit 230 within a certain range of fluctuations around a desired set pressure (i.e., the same mechanism components as a so-called "back-pressure regulator"). A second circulating pump 1004 serves as a negative pressure source that can reduce the pressure of the downstream side of the negative pressure control unit 230, and a first circulating pump (high pressure side) 1001 and a first circulating pump (low pressure side) 1002 are arranged on the upstream side from the liquid ejection head. The negative pressure control unit 230 is arranged on the downstream side from the liquid ejection head. As mentioned below, these pumps (1001, 1002, 1004) and the negative pressure control unit 230 serve as circulation units for circulating a liquid in the pressure chamber 23 in the liquid ejection head between the pressure chamber 23 and the outside of the pressure chamber 23.

The negative pressure control unit 230 acts in the following manner. The negative pressure control unit 230 acts in such a manner that the fluctuation in pressure on the upstream side (i.e., the liquid ejection unit 300 side) from the negative pressure control unit 230 becomes steady within a certain range around a preset pressure even when the flow amount is varied due to the change in recording Duty upon the recording by means of the liquid ejection head 3. As shown in FIG. 5, it is preferred to pressurize the downstream side of the negative pressure control unit 230 by the second circulating pump 1004 through a liquid supply unit 220. In this manner, the influence of the water head pressure of a buffer tank 1003 on the liquid ejection head 3 can be reduced. Therefore, the room for choice of the layout of the buffer tank 1003 in the inkjet recording device 1000 can be expanded. For example, a water-head-type tank which is arranged with a predetermined water head difference relative to the negative pressure control unit 230 can be used in place of the second circulating pump 1004.

As shown in FIG. 5, the negative pressure control unit 230 is equipped with two pressure adjusting mechanisms in which different control pressures are set. Among the two negative pressure adjusting mechanisms, one on the high pressure set side (written as "H" in FIG. 5) and one on the low pressure side (written as "L" in FIG. 5) are respectively connected to a common supply flow path 211 and a common collection flow path 212 in a liquid ejection unit 300 via a liquid supply unit 220. The two negative pressure adjusting mechanisms can make the pressure of the common supply flow path 211 higher relative to the pressure of the common collection flow path 212. As a result, an ink flow from the common supply flow path 211 toward the common collection flow path 212 via the insides of each of flow paths 213 and the pressure chamber 23 (FIGS. 15A to 15C) of each of recording element substrates 10 is generated (arrows in FIG. 5).

(Description of Configuration of Liquid Ejection Head)

Figure 6A:
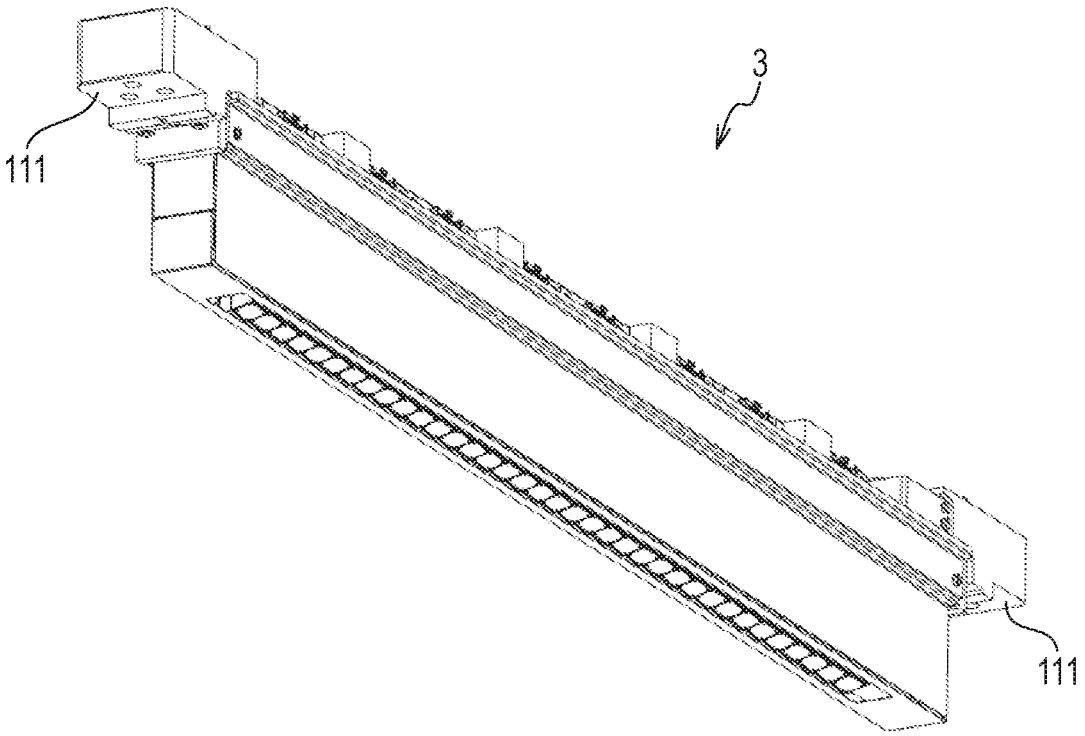
FIGS. 6A and 6B are perspective views of a liquid ejection head in the present embodiment.
Figure 6B:
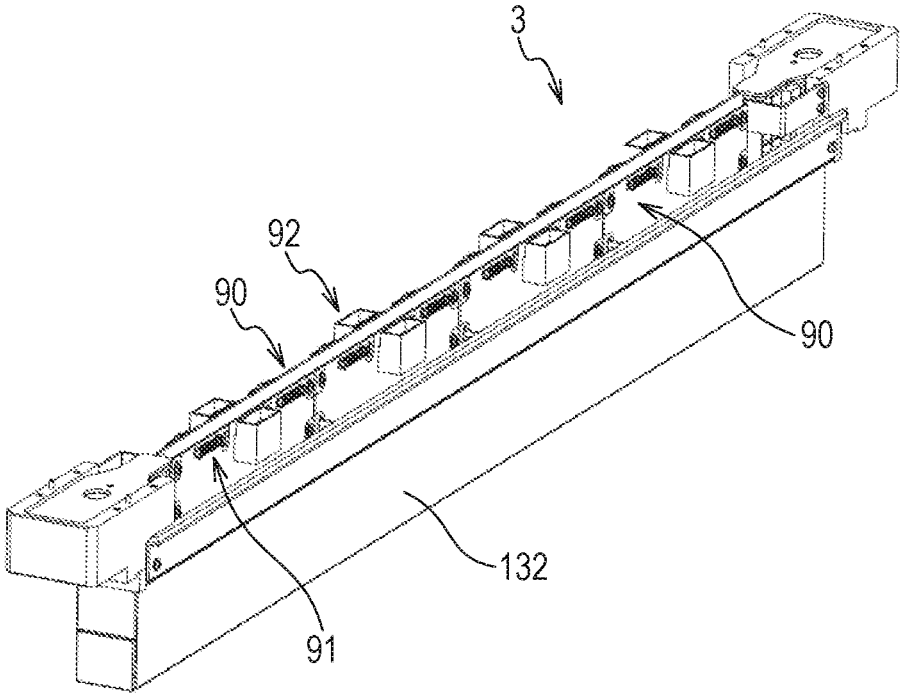
Figure 7:
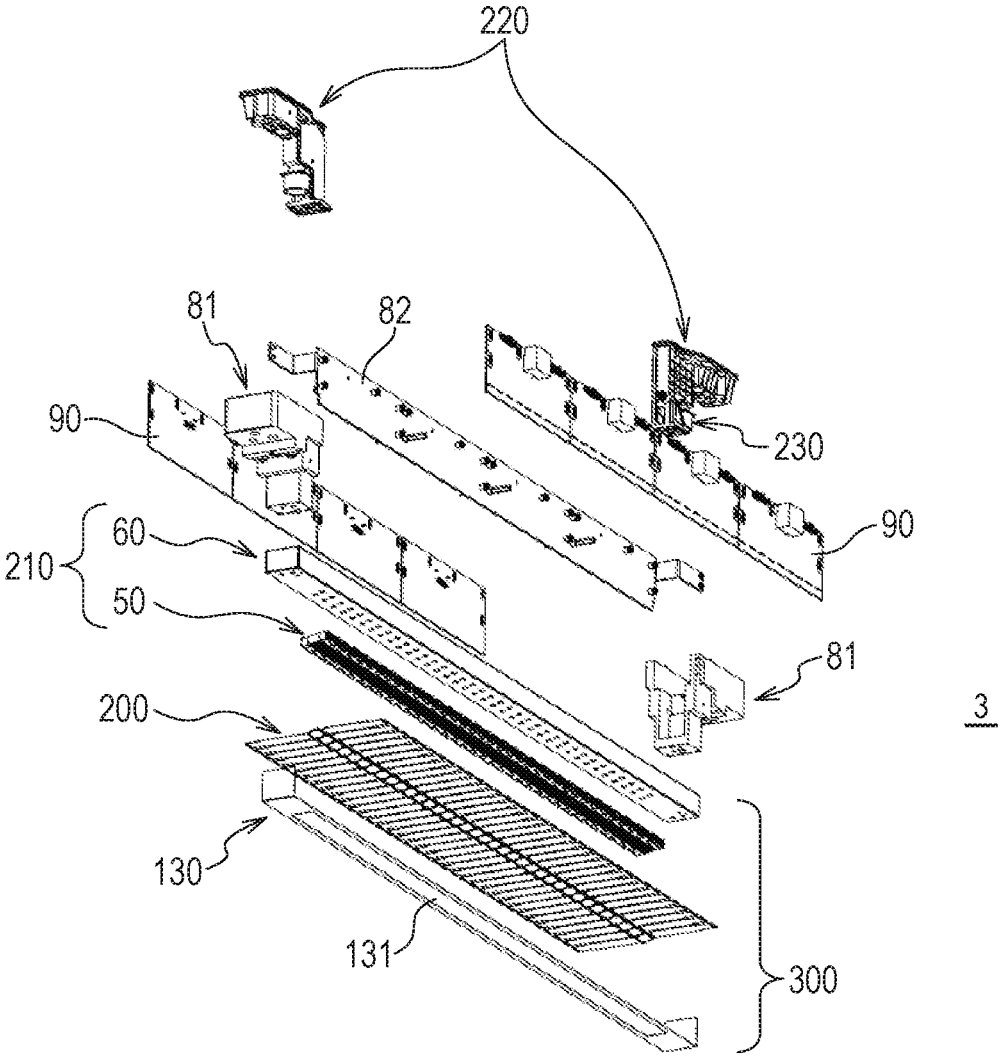
FIG. 7 is an exploded perspective view of the liquid ejection head in the present embodiment.

The configuration of the liquid ejection head 3 of the present embodiment will be described. FIGS. 6A and 6B are perspective views of the liquid ejection head 3 of the present embodiment, and FIG. 7 is an exploded perspective view of the liquid ejection head 3. The liquid ejection head 3 is provided with a plurality of recording element substrates 10 which are arranged in an in-line configuration in the direction of the length of the liquid ejection head 3, and is a pagewide-type liquid ejection head for recording with a single color of liquid. The liquid ejection head 3 is equipped with a liquid connection section 111, a signal input terminal 91, an electric power supply terminal 92, and a shield board 132 for protecting the length-direction side surface of the head. The signal output terminal 91 and the electric power supply terminal 92 are arranged at both sides of the liquid ejection head 3, respectively. This is for reducing the decrease in voltage or the delay of signal transmission occurring in a wiring section provided in the recording element substrate 10.

In FIG. 7, components or units constituting the liquid ejection head 3 are shown with respect to each function. In the liquid ejection head 3 of the present embodiment, the stiffness of the liquid ejection head is secured by a second flow path member 60 in a liquid ejection unit 300. The liquid ejection unit support section 81 in the present embodiment is connected to both ends of the second flow path member 60, and the liquid ejection unit 300 is bonded mechanically to a carriage of the inkjet recording device 1000 to perform the alignment of the liquid ejection head 3. Liquid supply units 220 each equipped with a negative pressure control unit 230 and an electric wiring substrate 90 bonded to an electric wiring substrate support section 82 are bonded to a liquid ejection unit support section 81. In each of the two liquid supply units 220, a filter (now shown) is housed. The two negative pressure control units 230 are set so as to control a pressure by different and relatively level-different negative pressures. When the high-voltage-side negative pressure control unit 230 and a low-voltage-side negative pressure control unit 230 are provided at both ends of the liquid ejection head 3, respectively, as shown in the drawing, the flows of a liquid in a common supply flow path 211 and a common collection flow path 212 which extend in the direction of the length of the liquid ejection head 3 are opposed to each other. According to this configuration, the heat exchange between the common supply flow path 211 and the common collection flow path 212 is accelerated to reduce the difference in temperature in the two common flow paths. Therefore, there is an advantage that the temperatures in a plurality of recording element substrates 10 rarely differ from each other along the common flow paths and therefore recording unevenness associated with this difference in temperature rarely occurs.

Next, the flow path member 210 in the liquid ejection unit 300 will be described in detail. As shown in FIG. 7, the flow path member 210 is a laminate of a first flow path member 50 and a second flow path member 60, and can distribute a liquid supplied from the liquid supply unit 220 into ejection modules 200. The flow path member 210 serves as a flow path member for returning the liquid circulating from the ejection module 200 to the liquid supply unit 220. The second flow path member 60 in the flow path member 210 is a flow path member having, formed therein, a common supply flow path 211 and a common collection flow path 212, and has a function to be involved in the stiffness of the liquid ejection head 3. Therefore, as the material for the second flow path member 60, a material having sufficient corrosion resistance and high mechanical strength is preferred. Specifically, SUS, Ti, alumina and the like can be used preferably.

Figure 8A:
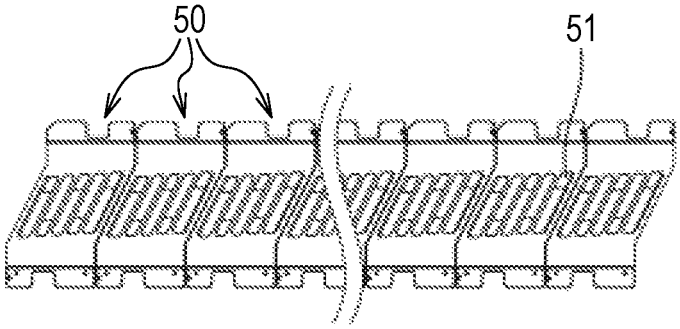
FIGS. 8A, 8B, 8C, 8D and 8E are plan views of first and second flow path members in the present embodiment.
Figure 8B:
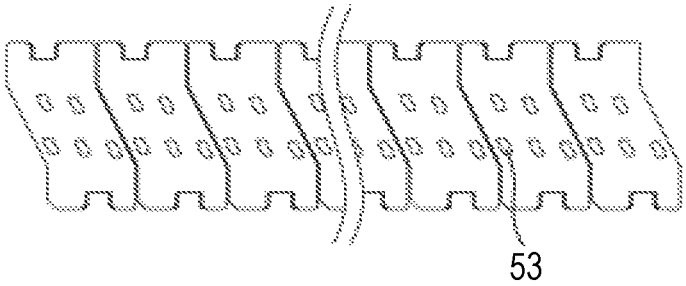
Figure 8C:
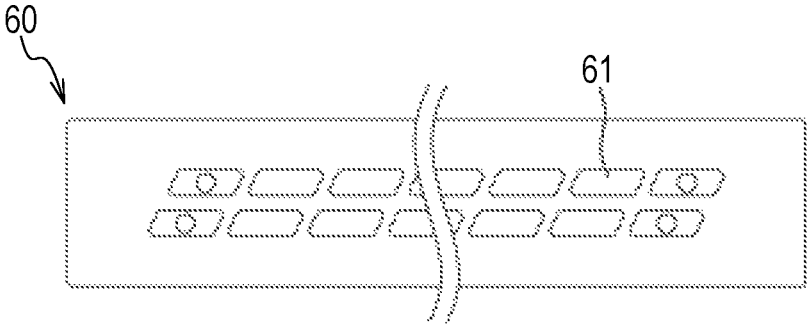
Figure 8D:
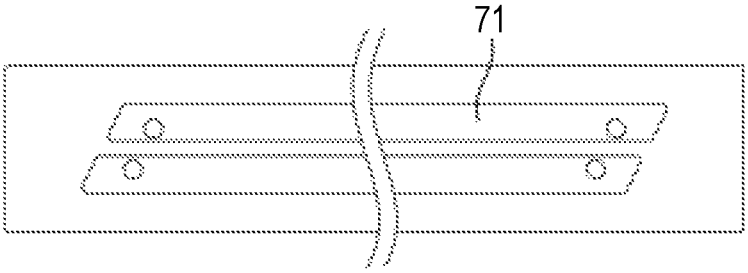
Figure 8E:
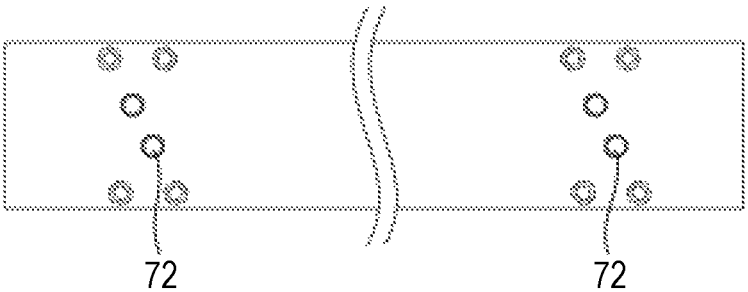

FIG. 8A shows a surface of the first flow path member 50 on which the ejection module 200 is to be mounted, and FIG. 8B shows the back of the surface which is in contact with the second flow path member 60. The first flow path member 50 is composed of a plurality of members which respectively correspond to ejection modules 200 and are arranged in a side-by-side configuration. By employing this divided structure and arranging a plurality of modules, it becomes possible to correspond with the length of the liquid ejection head. Therefore, this configuration can be applied particularly suitably to a liquid ejection head having a relatively long scale which corresponds to, for example, a B2 size or a longer. The communicating port 51 in the first flow path member 50 is fluidically communicated with the ejection module 200 as shown in FIG. 8A, and the individual communicating port 53 in the first flow path member 50 is fluidically communicated with the communicating port 61 of the second flow path member 60 as shown in FIG. 8B. FIG. 8C illustrates a surface of the second flow path member 60 on which the second flow path member 60 is contacted with the first flow path member 50, and FIG. 8D illustrates a cross section of the center of the second flow path member 60 as observed in the direction of the thickness, and FIG. 8E illustrates a surface of the second flow path member 60 on which the second flow path member 60 is contacted with the liquid supply unit 220. One of common flow path grooves 71 in the second flow path member 60 is a common supply flow path 211 shown in FIG. 9 and the other is a common collection flow path 212 shown in FIG. 9, and a liquid is supplied from one terminal side toward the other terminal side of each of the flow paths along the direction of the length of the liquid ejection head 3. The length direction of the liquid in the common supply flow path 211 is opposed to the length direction of the liquid in the common collection flow path 212.

FIG. 9 is a transparent view showing the connection relation between the liquid and the recording element substrates 10 and the flow path member 210. As shown in FIG. 9, a (common supply flow path 211)-(common collection flow path 212) pair (which extends in the length direction of the liquid ejection head 3) is provided in the flow path member 210. The communicating port 61 of the second flow path member 60 is connected to the individual communicating port 53 in the first flow path member 50 while aligning with the individual communicating port 53, thereby forming a liquid supply pathway that is communicated with the communicating port 51 in the first flow path member 50 from the communicating port 72 in the second flow path member 60 through the common supply flow path 211. In the same way, a liquid supply pathway is also formed which is communicated with the communicating port 51 in the first flow path member 50 from the communicating port 72 in the second flow path member 60 through the common collection flow path 212.

Figure 10:
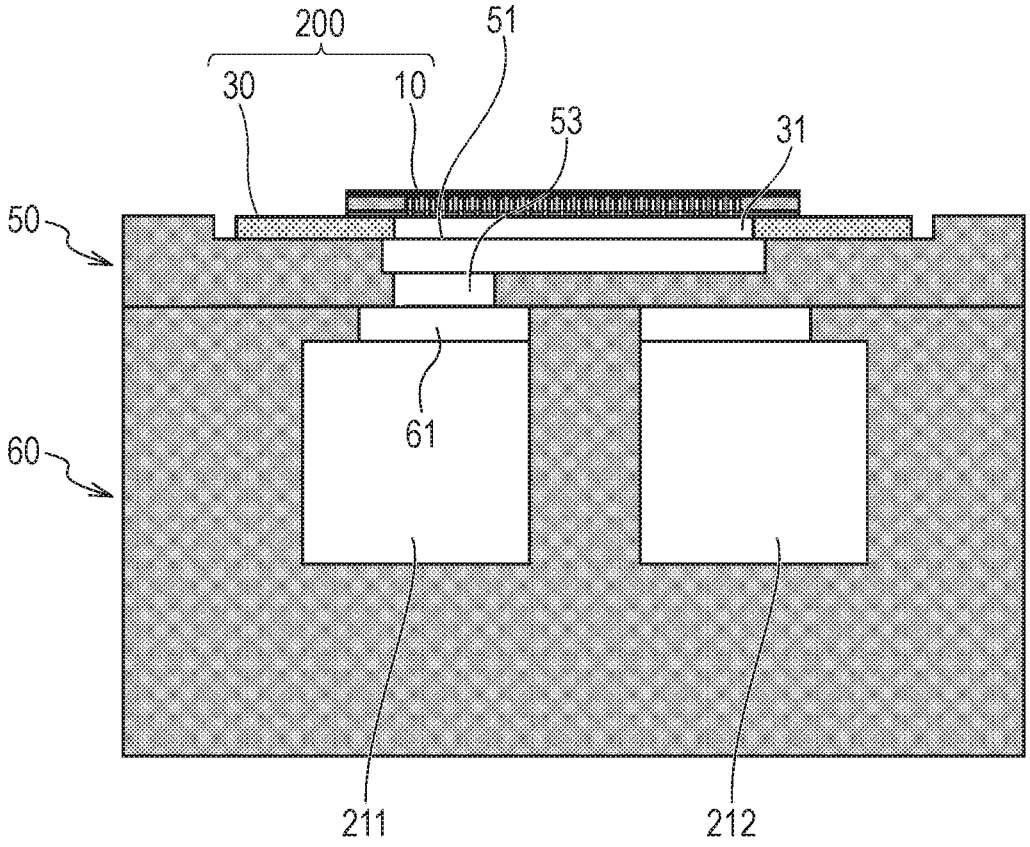
FIG. 10 is a cross-sectional view taken along line F-F in FIG. 9.

FIG. 10 illustrates a cross section taken along line F-F in FIG. 9. As shown in this drawing, the common supply flow path is connected to an ejection module 200 via the communicating port 61, the individual communicating port 53 and the communicating port 51. In another cross section, it is obvious from FIG. 9 that an individual collection flow path is also connected to the ejection module 200 through the same route. In each ejection module 200 and each recording element substrate 10, a flow path that communicates with each ejection orifice 13 is formed so that a portion or the whole of a supplied liquid can circulate through the ejection orifice 13 (pressure chamber 23) in which an ejection operation is paused. The common supply flow path 211 and the common collection flow path 212 are connected to a negative pressure control unit 230 (high pressure side) and a negative pressure control unit 230 (low pressure side), respectively, through the liquid supply unit 220. Due to the difference in pressure generated as the result of the connection, a flow from the common supply flow path 211 toward the common collection flow path 212 through the ejection orifice 13 (pressure chamber 23) in the recording element substrate 10 is generated.

(Description of Ejection Module)

Figure 11A:
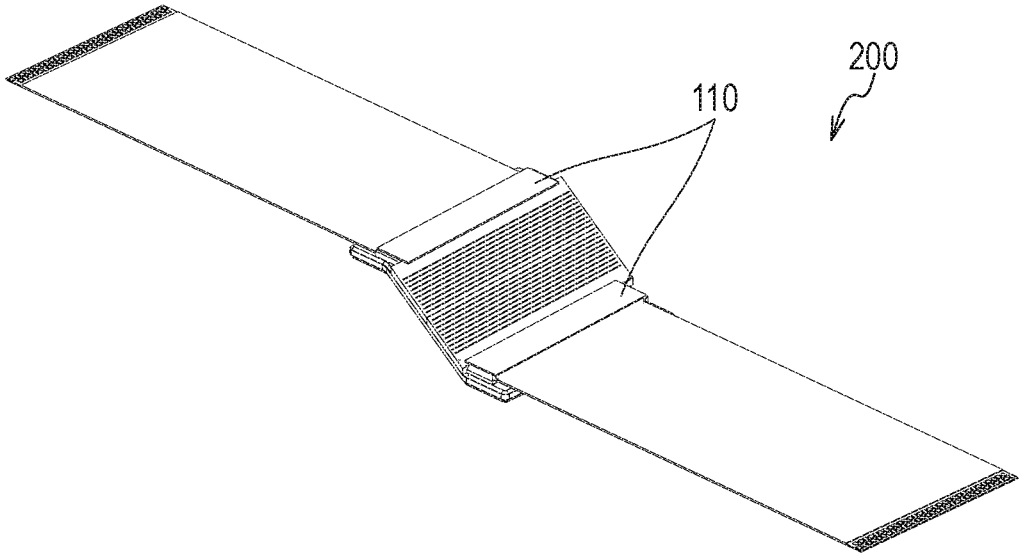
FIGS. 11A and 11B are a perspective view and an exploded perspective view of an ejection module in the present embodiment.
Figure 11B:
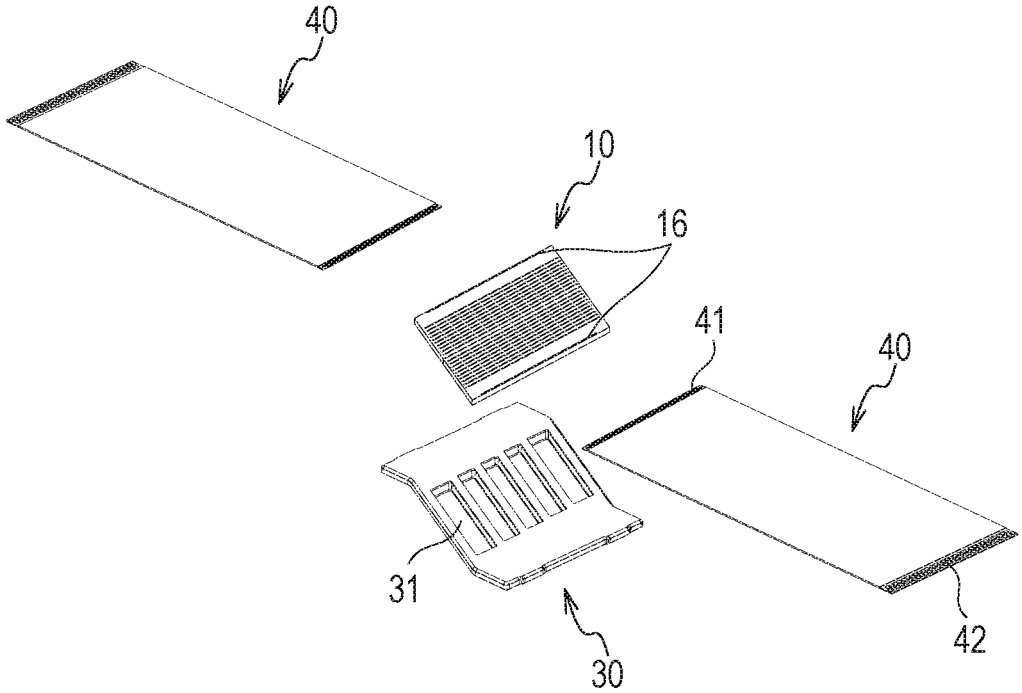

FIG. 11A illustrates a perspective view of one ejection module 200, and FIG. 11B illustrates a breakdown view thereof. A plurality of terminals 16 are respectively arranged in both edge parts of the recording element substrate 10 (both longer edge parts of the recording element substrate 10) along the direction of a plurality of ejection orifice rows, and two flexible wiring substrates 40 (which are electrically connected to the terminals 16) are arranged per one recording element substrate 10. This is because the number of ejection orifice rows provided in the recording element substrate 10 is 20 and consequently the number of wiring lines is also increased. Namely, it is intended to reduce the maximum distance between the terminals 16 and the energy-generating elements 15 (which are provided corresponding to the ejection orifice rows) to reduce the decrease in voltage or the delay of signal transduction in the wiring lines in the recording element substrate 10. Liquid communicating ports 31 in the support member 30 are provided in the recording element substrate 10 and are opened so as to cross all of the ejection orifice rows.

(Description of Structure of Recording Element Substrate)

Figure 12A:
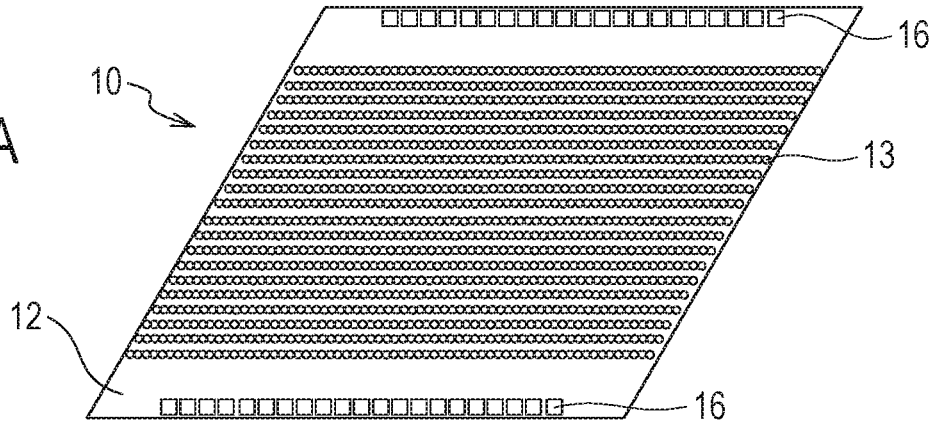
FIGS. 12A, 12B and 12C are plan views of a recording element substrate in the present embodiment.
Figure 12B:
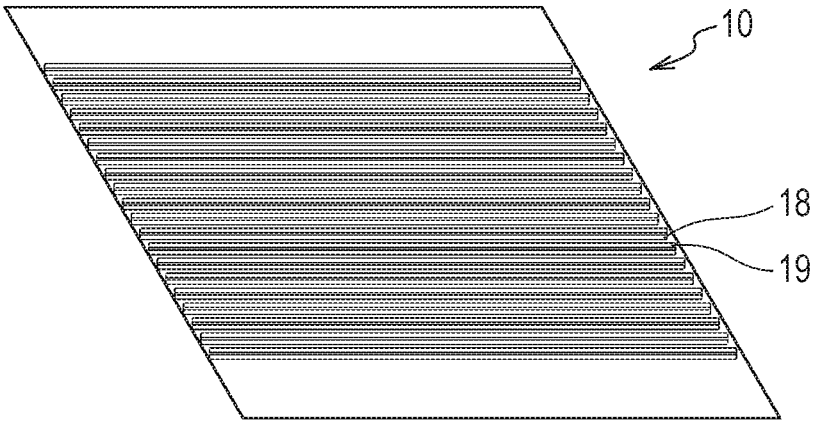
Figure 12C:
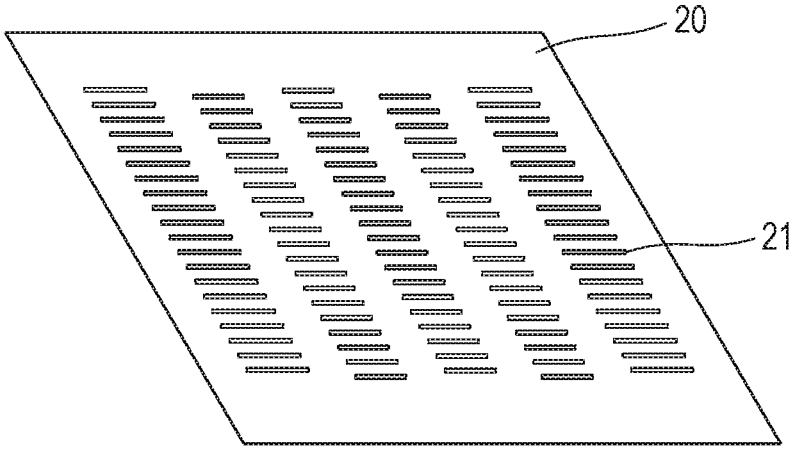

FIG. 12A is a schematic diagram of a side of the recording element substrate 10 on which the ejection orifices 13 are to be arranged, and FIG. 12C is a schematic diagram of the back of the surface shown in FIG. 12A. A plurality of ejection orifice rows are formed in an ejection orifice forming member 12 in the recording element substrate 10. The direction in which a plurality of ejection orifices 13 are arranged and the ejection orifice rows extend is also referred to as an "ejection orifice rows direction", hereinbelow.

Figure 13:
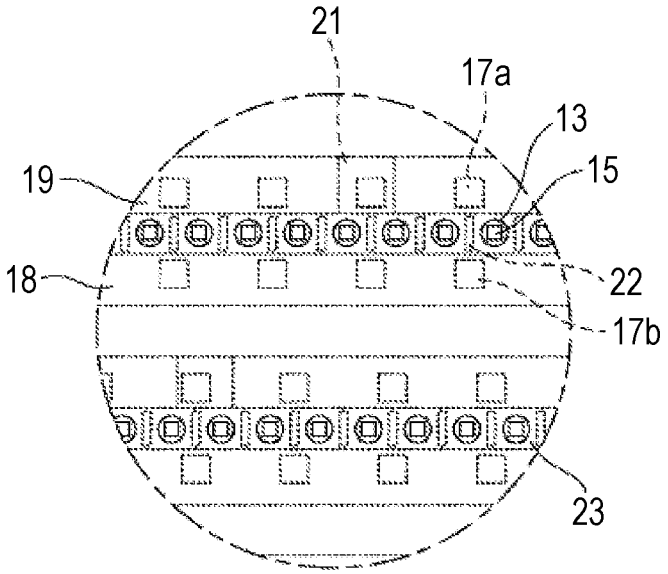
FIG. 13 is an enlarged plan view of a recording element substrate in the present embodiment.

FIG. 13 is a schematic diagram illustrating a surface of the recording element substrate 10 from which a lid member 20 provided on the back surface of the recording element substrate 10 is removed. As shown in FIG. 13, an energy-generating element 15 (which is a heat-generating element for foaming a liquid by a thermal energy) is arranged at a position corresponding to each ejection orifice 13. A pressure chamber 23 equipped with an energy-generating element 15 in the inside thereof is partitioned by a partitioning wall 22, and the energy-generating element 15 is placed therein. The energy-generating element 15 is electrically connected to a terminal 16 shown in FIG. 12A through an electric wiring line (not shown) provided on the recording element substrate 10. The energy-generating element 15 generates heat on the basis of a pulse signal input from a control circuit for the inkjet recording device 1000 through an electric wiring substrate 90 (FIG. 7) and a flexible wiring substrate 40 (FIGS. 11A and 11B) to boil a liquid. The liquid can be ejected through the ejection orifice 13 by the action of the force of bubbles formed by the boiling. On the back surface of the recording element substrate 10, a liquid supply passage 18 and a liquid collection passage 19 are provided alternately along the direction of the ejection orifice rows. The liquid supply passage 18 and the liquid collection passage 19 are flow paths extending in the direction of the ejection orifice rows provided in the recording element substrate 10, and each of the passages is communicated with an ejection orifice 13 through a supply port 17*a* and a collection port 17*b*. In the lid member 20, an opening 21 that communicates with the liquid communicating port 31 in the support member 30 is provided.

(Description of Positional Relationship Between Recording Element Substrates)

Figure 14:
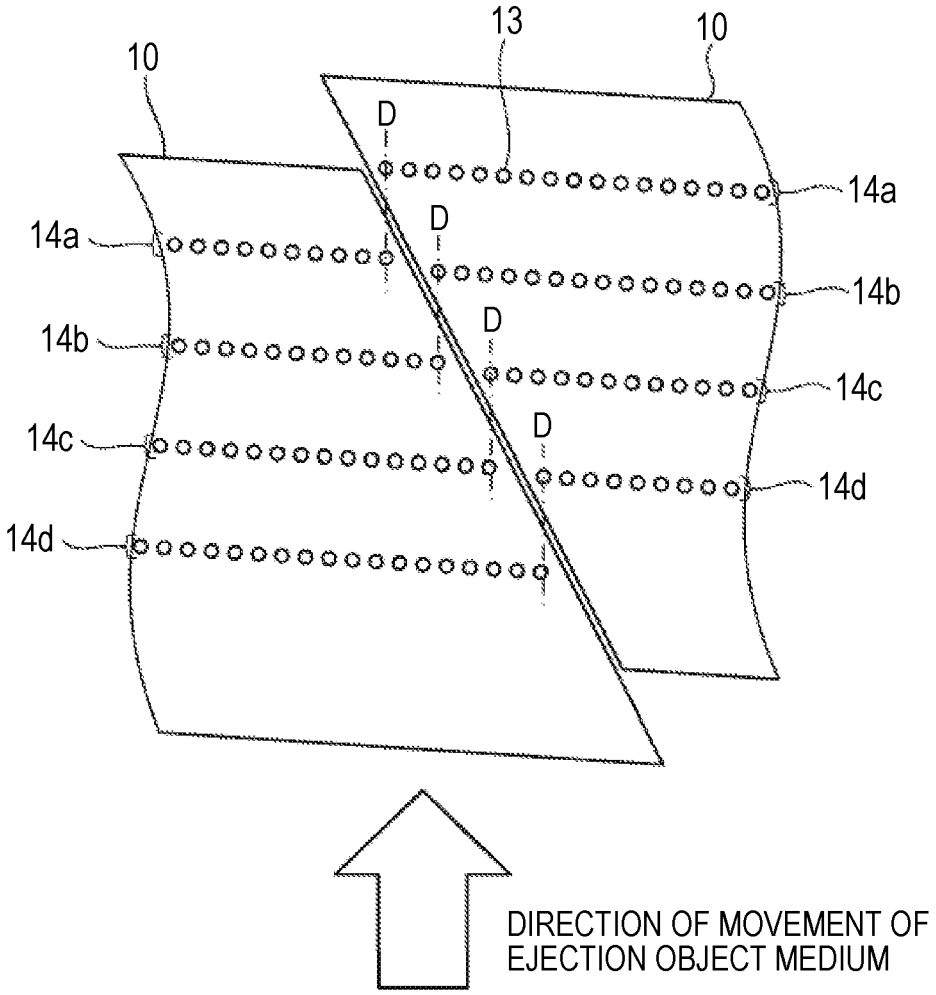
FIG. 14 is a partially enlarged plan view of adjacent parts of recording element substrates in the present embodiment.

FIG. 14 is a partially enlarged plan view that illustrates an adjacent part between recording element substrates in two adjacent ejection modules. As shown in FIGS. 12A to 12C, in the present embodiment, approximately parallelogram recording element substrates are used. As shown in FIG. 14, ejection orifice rows (14*a* to 14*d*) (in each of which ejection orifices 13 are arranged) in on each recording element substrate 10 are arranged tilting at a certain angle relative to the direction of movement of an ejection object medium. As a result, in the ejection rows in an adjacent part between the recording element substrates 10, at least one ejection orifice overlaps with another one in the direction of movement of the ejection object medium. In FIG. 14, two ejection orifices overlap with each other on line D. According to this configuration, even if the position of the recording element substrate 10 moves over a little from a predetermined position, the appearance of black streaks or voids in a recording image can be minimized by controlling the driving of the overlapped ejection orifices. Even in a case where a plurality of recording element substrates 10 are arranged in an in-line configuration rather than a zigzag configuration, the countermeasure to the formation of black streaks or voids at a joint part between the recording element substrates 10 can be taken while preventing the increase in the length of the liquid ejection heads 104 in the direction of the movement of the ejection object medium by employing the configuration shown in FIG. 14. In the present embodiment, the main flat surface of the recording element substrate is parallelogram, but is not limited thereto and the configurator of the present disclosure can be applied suitably even when a recording element substrate having a rectangular, trapezoidal or other shape is used.

(Structure of Vicinity of Ejection Orifice)

Next, the structures of the ejection orifice and the vicinity thereof in the above-mentioned liquid ejection head in the present embodiment will be described.

Figure 15A:
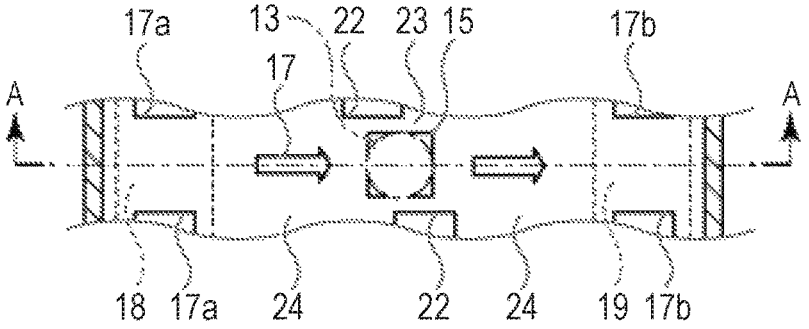
FIGS. 15A, 15B and 15C are a plan view, a cross-sectional view and a perspective view all illustrating a main part of a liquid ejection head.
Figure 15B:
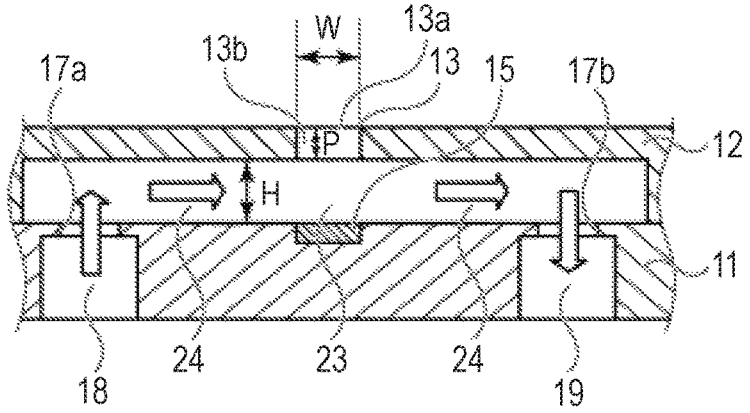
Figure 15C:
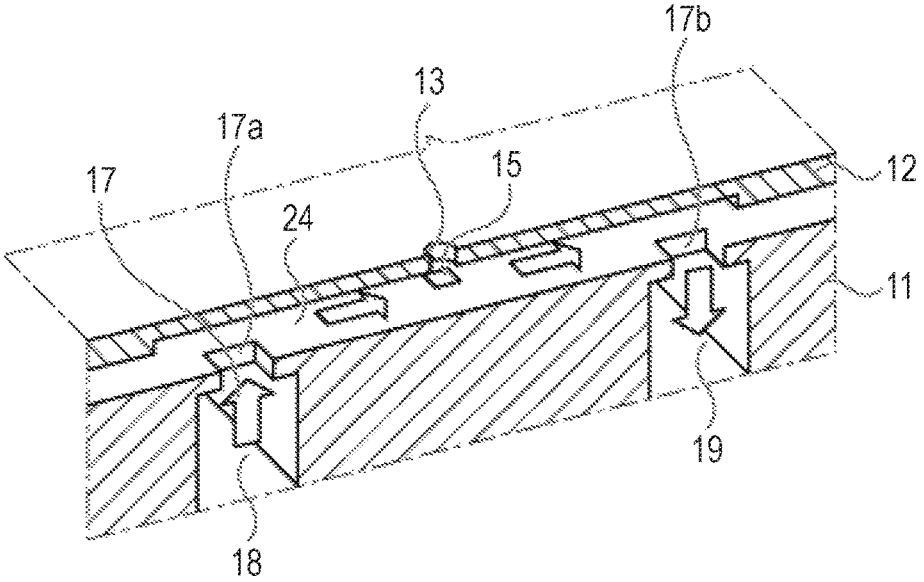

FIGS. 15A to 15C are schematic diagrams illustrating the structure of the vicinity of the ejection orifice in the liquid ejection head in the present embodiment in detail. FIG. 15A is a plan view observed from the ink-ejected side, FIG. 15B is a cross-sectional view taken along line A-A in FIG. 15A, and FIG. 15C is a perspective view illustrating a cross section taken along line A-A in FIG. 15A.

As shown in these drawings, an ink flow 17 is generated in the pressure chamber 23 having an energy-generating element 15 provided therein and the flow paths 24 on the both sides by the circulation of an ink which is described with respect to FIG. 5. Namely, the liquid in the liquid supply passage (inflow path) 18 provided in the substrate 11 flows into the liquid collection passage (outflow path) 19 through the supply port 17*a*, the (supply) flow path 24, the pressure chamber 23, the (collection) flow path 24 and the collection port 17*b* by the action of the difference in pressure that can cause the circulation of the ink. In the present embodiment, the velocity of the ink flow 17 in the flow path 24 and the pressure chamber 23 is, for example, about 0.1 to 100 mm/s, which is a velocity that has small influence on shot accuracy or the like even when the ejection operation is carried out while flowing the ink in the pressure chamber.

During the ink-unejected period, a gap space between the energy-generating element 15 and the ejection orifice 13 that is opposed thereto is filled with the ink. Therefore, an ink meniscus (ink boundary 13*a*) is formed in the vicinity of an end on the direction on which the above-mentioned ink flow 17 and a liquid is ejected through the ejection orifice 13 are ejected. In FIG. 15B, for the sake of shorthand, the ink boundary 13*a* is indicated by a straight line (flat surface). However, the shape of the ink boundary is defined by a member that forms the wall of the ejection orifice 13 and the surface tension of the ink, and is generally a concave or convex curve (curved surface). When a heat-generating element (heater) that serves as the energy-generating element 15 is driven in the state where the meniscus is formed, heat is generated and bubbles are generated in the ink by utilizing the heat, and consequently the ink can be ejected through the ejection orifice 13. The ejection orifice 13 is an opening located at an end on the direction of the ejection through a tubular ejection orifice part 13*b* that is formed in the ejection orifice forming member 12 as shown in FIG. 15B, and the ejection orifice part 13*b* allows the communication between the ejection orifice 13 and the pressure chamber 23. The direction on which the liquid is to be ejected through the ejection orifice 13 (the vertical direction shown in FIG. 15B) is referred to as an "ejection direction" and the direction of the flow of the liquid in the flow path 24 and the pressure chamber 23 (the horizontal direction shown in FIG. 15B) is simply referred to as a "flow direction".

As mentioned above, in the present embodiment, the ink ejection operation is carried out while flowing the ink through the flow path 24 between the ejection orifice 13 through the liquid ejection head and the energy-generating element 15 and through the pressure chamber 23. In this manner, a fresh ink can be supplemented while discharging an ink which is thickened or is change in coloring material concentration due the volatilization of water or the like by heat generated as the result of the ejection operation, heat generated as the result of the control of temperature of the recording element substrate 10 and heat coming from an external environment in the vicinity of the ejection orifice 13. As a result, it becomes possible to prevent the ejection failure caused by the thickening of the ink and the color unevenness in an image caused by the change in the concentration of a coloring material.

(Relationship with Dimension of Vicinity of Ejection Orifice)

Here, the dimensions of the pressure chamber 23 and the ejection orifice part 13*b* are defined as follows. As shown in FIG. 15B, the height of the pressure chamber 23 as measured on the upstream side of the direction of the flow of the liquid relative to a part at which the pressure chamber 23 communicates with the ejection orifice part 13*b* is defined as H, the length of the ejection orifice part 13*b* as measured in the direction of the ejection of the liquid is defined as P, and the length of the ejection orifice part 13*b* as measured in the direction of the flow of the liquid is defined as W. These dimensions are, for example, as follows: H is 3 to 30 μm, P is 3 to 30 μm and W is 6 to 30 μm. In the following description, the ink is so adjusted to have a nonvolatile solvent concentration of 30%, a coloring material concentration of 3% and a viscosity of 0.002 to 0.003 Pa·s.

In the present embodiment, for the purpose of preventing the thickening of the ink caused by the volatilization of the ink through the ejection orifice 13, the above-mentioned dimensions H, P and W of the pressure chamber 23 and the ejection orifice part 25 are defined as follows.

Figure 16:
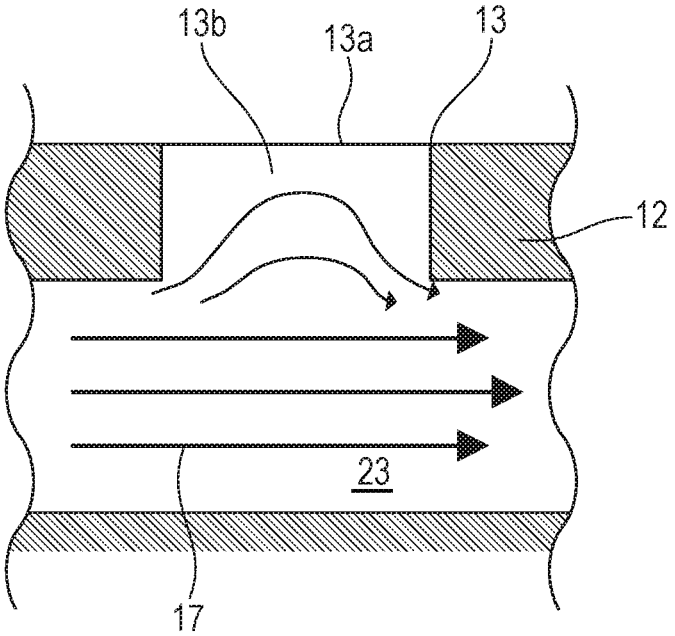
FIG. 16 is an enlarged cross-sectional view of a part adjacent to an ejection orifice in a liquid ejection head.

FIG. 16 is a diagram illustrating the flow of an ink flow 17 at the ejection orifice 13, the ejection orifice part 13*b* and the pressure chamber 23 when the ink flow 17 in the pressure chamber 23 (see FIG. 22) is in a steady state. More specifically, the state of the flow of an ink that has a flow rate of $1.26\times10^{-4}$ ml/min and flows from the liquid supply passage 18 into the pressure chamber 23 through a liquid ejection head in which the H value is 14 μm, the P value is 10 μm and the W value is 17 μm is shown. In this drawing, the length of each arrow does not indicate the degree of the velocity of the ink flow.

In the liquid ejection head having the above-mentioned dimensions, the height H of the pressure chamber 23 on the upstream side of the flow direction, the length P of the ejection orifice part 25 in the ejection direction and the length W of the ejection orifice part 25 in the flow direction satisfy the requirement represented by the following formula.

$$H^{-0.34}\times P^{-0.66}\times W>1.58 \quad (1)$$

When this requirement is satisfied, the ink flowing in the pressure chamber 23 flows into the ejection orifice part 13*b* and then reaches a position located at least the half of the ejection orifice part 13*b* as observed in the ejection direction, and then returns again to the pressure chamber 23, as shown in FIG. 16. The ink that returns to the pressure chamber 23 flows into the above-mentioned common collection flow path 212 via the liquid collection passage 19. Namely, at least a portion of the ink flow 17 reaches a position located the half of the ejection orifice part 13*b* as observed in the ejection direction from the pressure chamber 23, and then returns to the pressure chamber 23. Due to this flow, the occurrence of thickening of the ink can be prevented in many regions in the ejection orifice part 13*b*. When this ink flow is generated in the liquid ejection head, the ink in the inside of the ejection orifice part 13*b* can flow into the pressure chamber 23 and therefore it becomes possible to prevent the thickening of the ink and the increase in the concentration of a coloring material.

Furthermore, in the present embodiment, in order to further reduce the influence of the thickening of the ink and the like caused by the volatilization of the ink through the ejection orifice 13, it is preferred to define the above-mentioned dimensions H, P and W of the pressure chamber 23 and the ejection orifice part 25 as follows.

Figure 17:
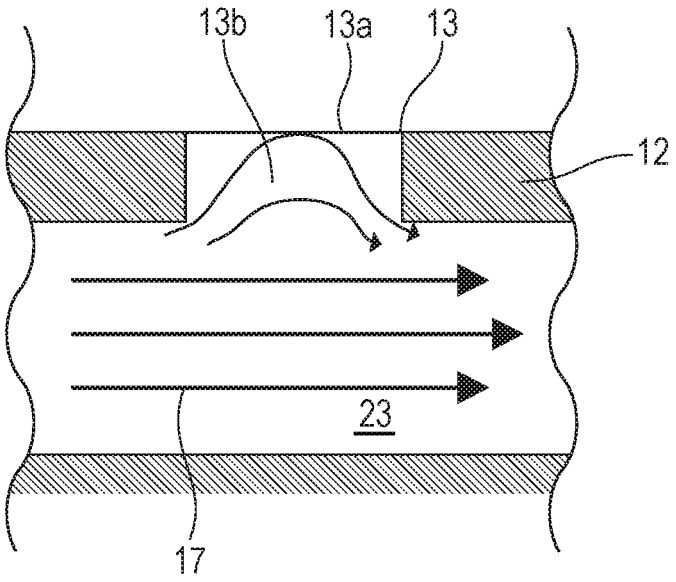
FIG. 17 is an enlarged cross-sectional view of a part adjacent to an ejection orifice in a liquid ejection head.

As in the case of FIG. 16, FIG. 17 is a diagram illustrating the flow of an ink flow 17 at the ejection orifice 13, the ejection orifice part 13*b* and the pressure chamber 23 when the ink flow 17 in the pressure chamber 23 is in a steady state. More specifically, the state of the flow of an ink that has a flow rate of $1.26\times10^{-4}$ ml/min and flows from the liquid supply passage 18 into the pressure chamber 23 through a liquid ejection head in which the H value is 14 μm, the P value is 5 μm and the W value is 12.4 μm is shown. In this drawing, the length of each arrow does not indicate the degree of the velocity of the ink flow, but indicates a certain length regardless of the degree of the velocity.

In the liquid ejection head having the above-mentioned dimensions, the height H of the pressure chamber 23 on the upstream side of the flow direction, the length P of the ejection orifice part 25 in the ejection direction and the length W of the ejection orifice part 25 in the flow direction satisfy the requirement represented by formula (2) shown below. In this case, it becomes possible to more effectively prevent the accumulation of the ink (in which the concentration of a coloring material is changed or which is thickened as the result of the volatilization of water or the like through the ejection orifice 13) in the vicinity of the ink boundary 13*a* in the ejection orifice part 13*b*, compared with the case shown in FIG. 16. Namely, as shown in FIG. 17, the ink flowing in the pressure chamber 23 flows into the ejection orifice part 13*b*, then reaches the vicinity of the ink boundary 13*a* (the position of the meniscus), and then returns again to the pressure chamber 23 through the ejection orifice part 13*b*. The ink that returns to the pressure chamber 23 flows into the above-mentioned common collection flow path 212 through the liquid collection passage 19. Due to this flow, the ink in the ejection orifice part 13*b* that can be greatly affected by the volatilization as well as the ink in the vicinity of the ink boundary 13*a* that can be significantly affected by the volatilization can flow into the pressure chamber 23 without being accumulated in the inside of the ejection orifice part 13*b*. As a result, the ink in the vicinity of the ejection orifice 13, particularly at a position that can be affected by the volatilization of water or the like, can be flown out without being accumulated in the position, and consequently the thickening of the ink and the increase in the concentration of a coloring material can be prevented. In the example shown in FIG. 16, it becomes possible to prevent the increase in the viscosity of the ink in at least a part of the ink boundary 13*a*, and therefore the influence of the change in ejection speed or the like on the ejection can be reduced more effectively compared with the case where the viscosity of the ink increases in the whole area of the ink boundary 13*a*.

The above-mentioned ink flow 17 has a velocity component in the flow direction (i.e., the left-to-right direction shown in FIG. 15B) (also referred to as a "positive velocity component", hereinafter) at least in the vicinity of the center part (the center part of the ejection orifice) in the vicinity of the ink boundary 13*a*. In the following statements, a flow mode in which the ink flow 17 has a positive velocity component at least in the vicinity of the center part in the vicinity of the ink boundary 13*a* is referred to as "flow mode A". A flow mode in which the ink flow 17 has a negative velocity component in a direction opposed to the direction of the positive velocity component (i.e., the right-to-left direction shown in FIG. 15B) in the vicinity of the center part of the ink boundary 13*a*, as mentioned below, is referred to as "flow mode B".

Figure 18A:
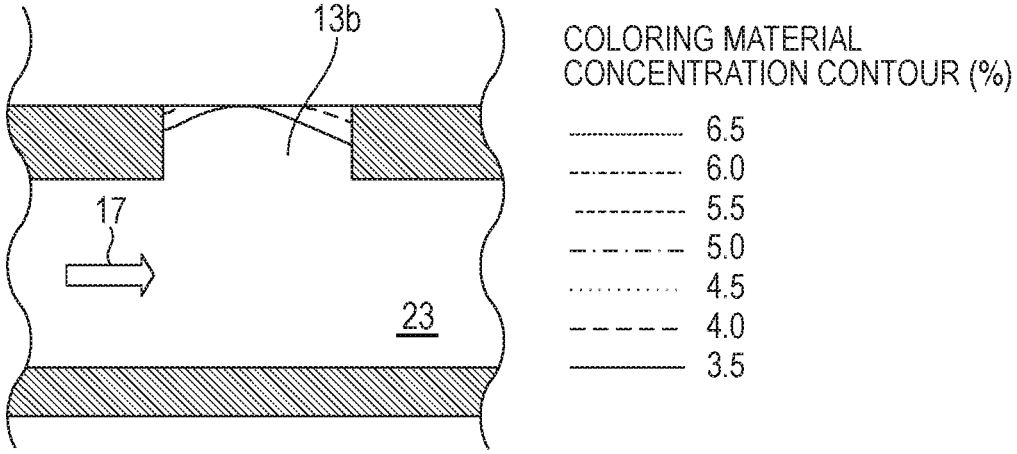
FIGS. 18A and 18B are diagrams illustrating the state of the concentration of a coloring material in an ink in an ejection orifice part.
Figure 18B:
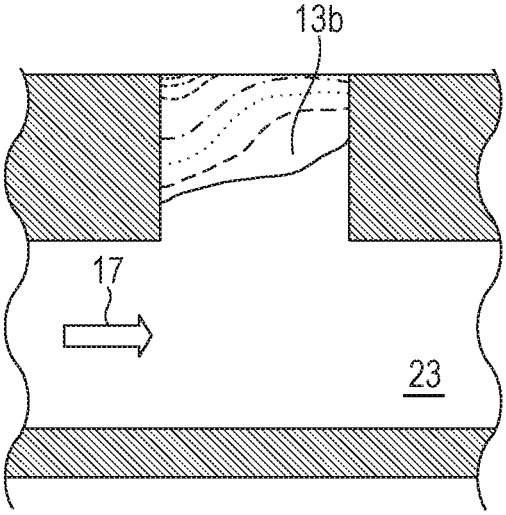

FIGS. 18A and 18B are diagrams illustrating the distributions of the concentration of a coloring material in an ink in the ejection orifice part 13*b* in the liquid ejection head in flow mode A and flow mode B, respectively, in the form of contours. More specifically, FIGS. 18A and 18B illustrate the concentrations of a coloring material in an ink having a flow rate of $1.26\times10^{-4}$ ml/min in the form of contours when the ink is flown into the pressure chamber 23 in the liquid ejection heads having flow mode A and flow mode B, respectively. Each of the flow modes A and B is determined depending on the dimensions H, P and W. FIG. 18A corresponds to a liquid ejection head having a H value of 14 μm, a P value of 5 μm and a W value of 12.4 μm, in which the flow mode is flow mode A. FIG. 18B corresponds to a liquid ejection head having a H value of 14 μm, a P value of 11 μm and a W value of 12.4 μm, in which the flow mode is flow mode B.

In flow mode B shown in FIG. 18B, the concentration of the coloring material in the ink in the ejection orifice part 13*b* is higher than that in flow mode A shown in FIG. 18A. Namely, in flow mode A shown in FIG. 18A, the ink flow 17 having a positive velocity component reaches in the vicinity of the ink boundary 13*a*, and consequently the ink in the ejection orifice part 13*b* can be moved (flown out) to the pressure chamber 23. As a result, in flow mode A, the accumulation of the ink in the ejection orifice part 13*b* can be prevented, and consequently the increase in the concentration of the coloring material or the increase in viscosity can be prevented.

Figure 19:
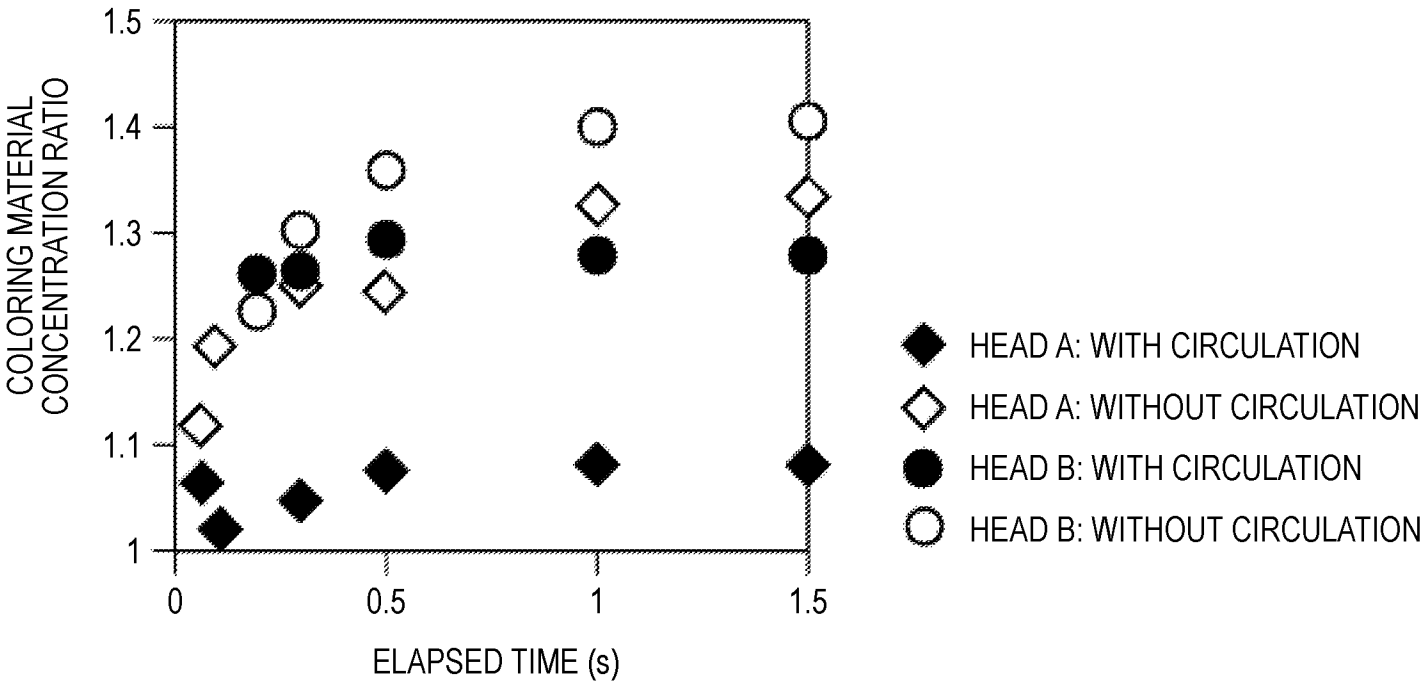
FIG. 19 is a graph showing the results of the comparison of the concentrations of coloring materials in an ink on an ejection object medium.

FIG. 19 is a graph showing the results of the comparison of the coloring material concentration in each of an ink that is ejected through a liquid ejection head of flow mode A (head A) and an ink that is ejected through a liquid ejection head of flow mode B (head B). More specifically, the experimental results of the comparison of the coloring material concentration in an ink on an ejection object medium through each of heads A and B in each of a case where the ejection of the ink is carried out in such a state that the ink flow 17 is generated in the pressure chamber 23 and a case where the ejection of the ink is carried out in such a state that the ink flow 17 is not generated (i.e., there is no ink flow) in the pressure chamber 23 are shown. The transverse axis indicates the time elapsed after the ejection of the ink through the ejection orifice, and the vertical axis indicates the coloring material concentration ratio of dots formed by the ejected ink on the ejection object medium, specifically a ratio wherein the concentration of dots formed by the ink ejected at an ejection frequency of 100 Hz is defined as 1.

As shown in FIG. 19, when no ink flow 17 is generated, the concentration ratio becomes 1.3 or more within 1 second or longer of the elapsed time at both of heads A and B, and the coloring material concentration in the ink becomes high at a relatively early time point after the ejection of the ink. At head B, when an ink flows 17 is generated, the concentration ratio becomes about 1.3 and the increase in the coloring material concentration can be reduced more effectively compared with the case where no ink flow is generated. In this case, at the ejection orifice part 13*b*, the ink in which the coloring material concentration is increased to up to 1.3 is accumulated in a small amount. In contrast, in the case where an ink flow is generated at head A, the color material concentration range can be reduced to 1.1 or less and therefore this case is more preferred. From the studies made by the present disclosures, it is found that it is difficult to visually confirm the unevenness in color when the change in coloring material concentration is about 1.2 or less. That is, head A is preferred than head B, because head A can prevent the change in coloring material concentration in such a level that unevenness in color can be visually confirmed even when the elapsed time is about 1.5 seconds. Although FIG. 19 shows a case where the coloring material concentration increases with the progression of volatilization, the same is true in a case where the coloring material concentration decreases with the progression of volatilization. Therefore, by causing the ink in the pressure chamber 23 to flow, the thickening of the ink in the ejection orifice 13 and the ejection orifice part 13*b* can be prevented.

From the studies made by the present disclosures, it is found that whether or not flow mode A is generated (or flow mode B is generated) at a liquid ejection head depends on the dimensions H, P and W in the pressure chamber 23 and the ejection orifice part 25, as mentioned above. In other words, in head A, the height H of the pressure chamber 23 as measured on the upstream side of the flow direction, the length P of the ejection orifice part 25 as measured in the ejection direction, and the length W of the ejection orifice part 25 as measured in the flow direction satisfy the relationship represented by the following formula.

$$H^{-0.34}\times P^{-0.66}\times W>1.7 \quad (2)$$

Therefore, a liquid ejection head that satisfies the relationship represented by formula (2) is head A as shown in FIG. 17, and a liquid ejection head that does not satisfy the relationship represented by formula (2) is head B. Hereinbelow, the value of the left member in formula (2) is referred to as a "determination value J".

Figure 20:
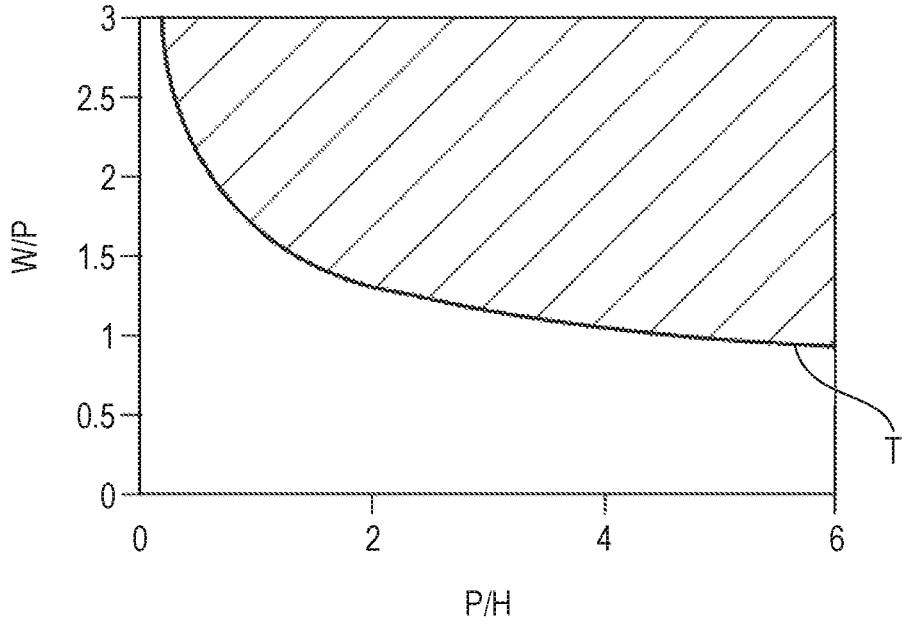
FIG. 20 is a graph for describing the relationship between a head size and a flow mode.

FIG. 20 is a graph for describing the relationship between each dimension in the liquid ejection head and the type of flow mode. The transverse axis indicates a ratio of P to H (P/H), and the vertical axis indicates a ratio of W to P (W/P). In the drawing, the bold line T indicates a threshold line that satisfies the relationship represented by formula (3).

$$(W/P)=1.7\times(P/H)^{-0.34} \quad (3)$$

In FIG. 20, a liquid ejection head in which the relationship among H, P and W falls within a zone which is located above the threshold line T and which is marked with diagonal lines is head A, and a liquid ejection head in which the relationship among H, P and W falls within a zone which is located below the threshold line T is head B. In other words, a liquid ejection head in which H, P and W satisfy the relationship represented by formula (4) is head A.

$$(W/P)>1.7\times(P/H)^{-0.34} \quad (4)$$

By marshaling formula (4), formula (1) is obtained. Therefore, in a liquid ejection head in which the relationship among H, P and W satisfies formula (1) (i.e., a liquid ejection head having a determination value J of 1.7 or more), flow mode A is achieved.

The above-mentioned relational formulae will be described in more detail with reference to FIGS. 21A to 21D and 22. FIGS. 21A to 21D are diagrams illustrating the state of the ink flow 17 in the ejection orifice part 13*b* at liquid ejection heads in each of which the above-mentioned relationship falls within a zone located above the threshold line T or a zone located below the threshold line T shown in FIG. 20. FIG. 22 is a graph showing the results of the confirmation as to whether the flow in the ejection orifice part 13*b* is in flow mode A or flow mode B with respect to liquid ejection heads having various shapes. In FIG. 22, each of black circles indicates a liquid ejection head that is in flow mode A, and each of cross marks indicates a liquid ejection head that is in flow mode B.

Figure 21A:
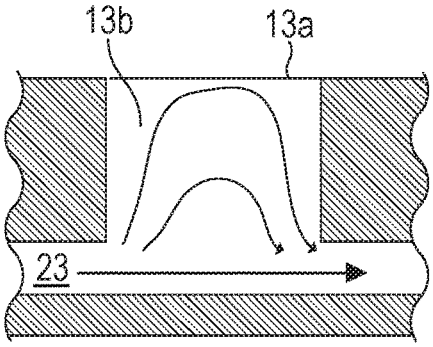
FIGS. 21A, 21B, 21C and 21D are diagrams illustrating the state of the ink flow in an ejection orifice part.
Figure 22:
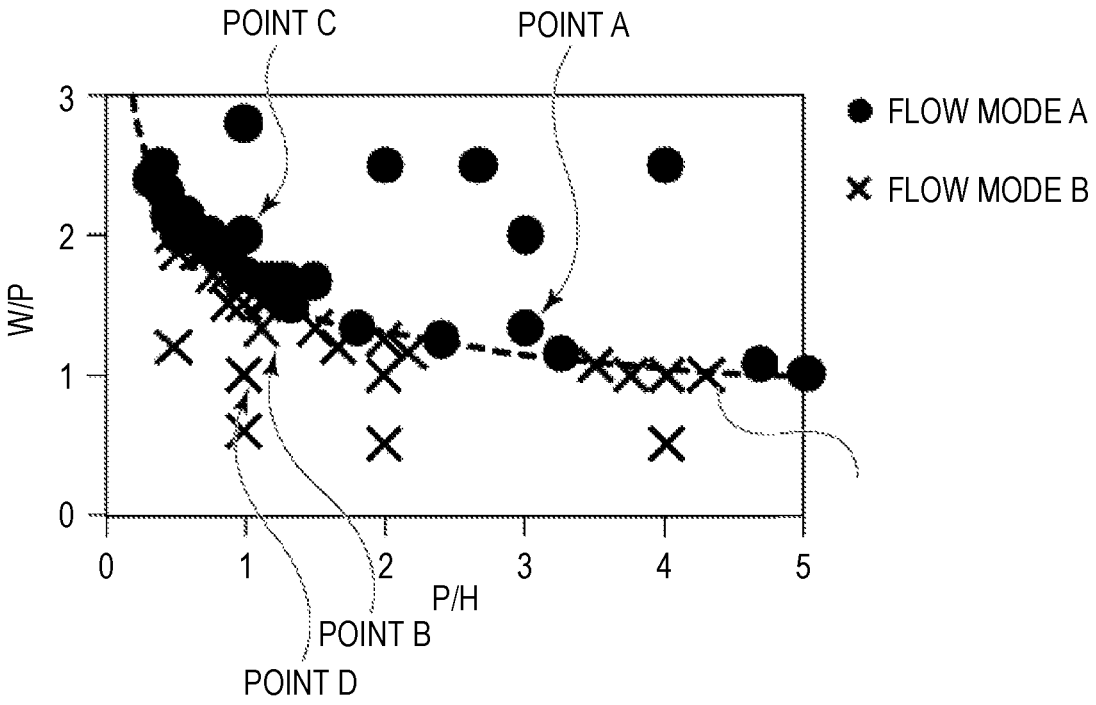
FIG. 22 is a graph showing the results of the confirmation of the relationship between a head dimension and a flow mode.

FIG. 21A shows the ink flow in a liquid ejection head having a H value of 3 μm, a P value of 9 μm and a W value of 12 μm and also having a determination value J of 1.93 that is larger than 1.7. Namely, the example shown in FIG. 21A corresponds to head A, and corresponds to point A in FIG. 22.

Figure 21B:
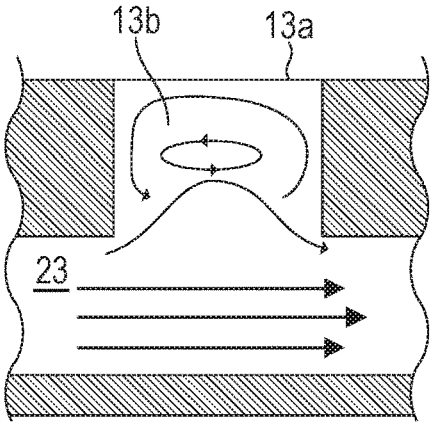

FIG. 21B shows the ink flow in a liquid ejection head having a H value of 8 μm, a P value of 9 μm and a W value of 12 μm and also having a determination value J of 1.39 that is smaller than 1.7. Namely, the example shown in FIG. 21B corresponds to head B, and corresponds to point B in FIG. 22.

Figure 21C:
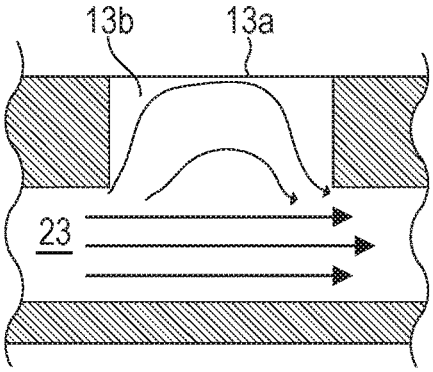

FIG. 21C shows the ink flow in a liquid ejection head having a H value of 6 μm, a P value of 6 μm and a W value of 12 μm and also having a determination value J of 2.0 that is larger than 1.7. Namely, the example shown in FIG. 21C corresponds to head A, and corresponds to point C in FIG. 22.

Figure 21D:
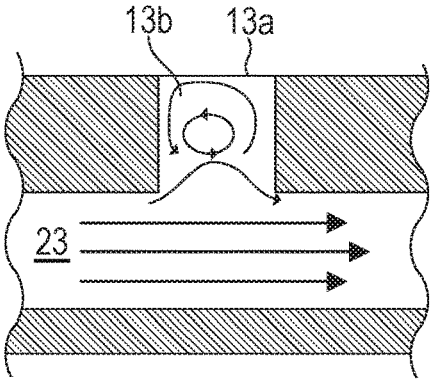

FIG. 21D shows the ink flow in a liquid ejection head having a H value of 6 μm, a P value of 6 μm and a W value of 6 μm and also having a determination value J of 1.0 that is smaller than 1.7. Namely, the example shown in FIG. 21D corresponds to head B, and corresponds to point D in FIG. 22.

As mentioned above, head A and head B can be distinguished from each other by the threshold line T in FIG. 20 as the boundary. Namely, a liquid ejection head in which the determination value J in formula (2) is larger than 1.7 serves as head A, wherein the ink flow 17 has a positive velocity component at least in the vicinity of the center part of the ink boundary 13*a*.

Figure 23A:
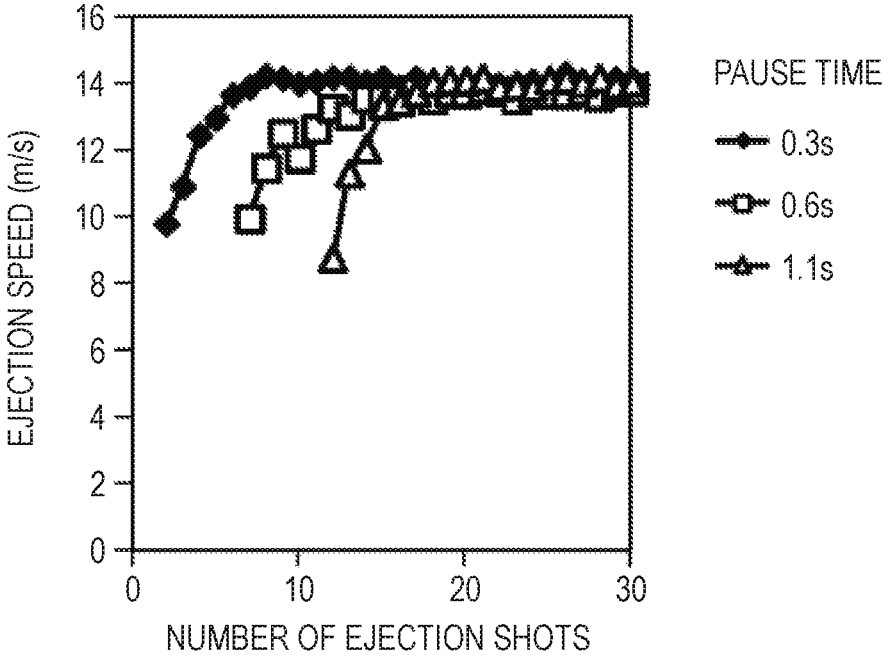
FIGS. 23A and 23B are graphs in each of which ejection speeds relative to the number of ejections after the pause of ejection are plotted.
Figure 23B:
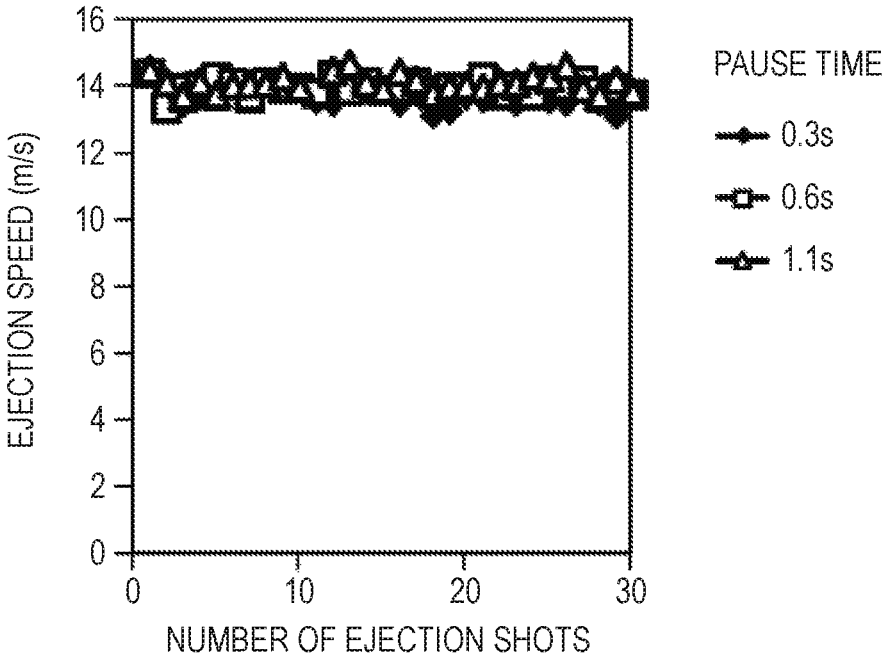

Next, the results of the comparison of ejection speeds of ink droplets ejected through head A and ink droplets ejected through head B will be described. FIG. 23A and FIG. 23B are graphs in which an ink is ejected through each of heads A and B, then the pause time is varied at some levels, and the ejection speed relative to the number of ejection shots after the pause is plotted. FIG. 23A shows the relationship between the number of ejection shots and the ejection speed after pause when a pigment ink that has an ink viscosity of about 4 cP (0.004 Pa·s) at a temperature at the time point of ejection and contains a solid material in an amount of 20% by weight or more is ejected using head B. FIG. 23B shows the relationship between the number of ejection shots and the ejection speed after pause when the same pigment ink as that used in FIG. 23A is ejected using head A.

As shown in the drawings, the decrease in ejection speed is observed until about 20 shots in some pause times even when there is an ink flow 17 in the case where head B is used, while the decrease in ejection speed is not substantially observed regardless of the length of the pause times in the case where head A is used. In FIGS. 23A and 23B, the experimental results using an ink containing a solid material in an amount of 20% by weight or more are shown. However, this concentration does not limit the scope of the present disclosure. It is confirmed that the effect of mode A is exerted clearly when an ink having a solid content of about 8% by weight or more (8 wt % or more) is ejected although the dispersibility of the solid content in the ink may affect.

As mentioned above, although the use of head B is effective for the prevention of the thickening of the ink in the ejection orifice part 13*b* when the ink in the pressure chamber 23 is allowed to flow, the use of head A is more effective for the prevention of thickening of the ink. When head A is used, the decrease in ink droplet ejection speed after the pause of the ejection operation can be prevented even if an ink of which the ejection speed is likely to decrease due to the thickening of the ink caused by the volatilization of water or the like through ejection orifices is used.

With respect to a matter as to which the mode of the ink flow 17 in the ejection orifice part 13*b* is, flow mode A or flow mode B, the relationship among the above-mentioned dimensions H, P and W has predominant influence under ordinary environments. Other requirements, such as the flow rate of the ink flow 17, the viscosity of the ink, the width of the ejection orifice 13 (i.e., the length as measured in a direction orthogonal to the flow direction) have extremely small influence compared with the requirements for H, P and W. Therefore, the flow rate and viscosity of the ink mat be adjusted appropriately depending on the type of the liquid ejection head (inkjet recording device) or the environmental conditions to be employed. For example, an ink that has an ink flow rate of the ink flow 17 in the pressure chamber 23 of 0.1 to 100 mm/s and has an ink viscosity of 30 cP (0.03 Pa·s) or less at a temperature during ejection can be used. In the case where the amount of the ink volatilized through the ejection orifices caused by environmental change during use or the like is largely increased in a liquid ejection head in flow mode A, the flow mode A can be maintained by increasing the flow rate of the ink flow 17 appropriately. On the other hand, with respect to a liquid ejection head in flow mode B, the mode cannot be converted into flow mode A even if the flow rate of the ink flow is increased at the highest. In other words, a matter as to which mode the flow has, flow mode A or flow mode B, is predominantly determined not by the requirements such as the flow rate or viscosity of the ink but by the above-mentioned requirements for the dimensions H, P and W. Among liquid ejection heads that can take flow mode A, a liquid ejection head having a H value of 20 μm or less, a P value of 20 μm or less and a W value of 30 μm or less is more preferred because highly accurate recording can be achieved.

As mentioned above, in a liquid ejection head in flow mode A, an ink flow 17 having a positive velocity component reaches in the vicinity of the ink boundary 13*a*, and therefore the ink in the ejection orifice part 13*b*, particularly the ink in the vicinity of the ink boundary 13*a*, can be conveyed to the pressure chamber 23. As a result, the accumulation of the ink in the ejection orifice part 13*b* can be prevented, and therefore it becomes possible to further reduce the increase in coloring material concentration in the ejection orifice part 13*b* or the like even when the ink is volatilized through the ejection orifice 13. Furthermore, as mentioned above, the ink ejection operation is carried out in a state where the ink is flowing in the pressure chamber 23, i.e., a state where there is such an ink flow that the ink enters into the ejection orifice part 13*b* from the pressure chamber 23, then reaches the ink boundary 13*a* and then is returned to the pressure chamber 23 again. As a result, a state where the increase in coloring material concentration in the ejection orifice part 13*b* is always reduced is formed in both of flow modes A and B even when the ejection operation is paused, and therefore the first ejection shot after the pause is satisfactorily performed and the occurrence of unevenness in color or the like can also be reduced.

The present disclosure is not intended to be limited by the embodiments mentioned above, and various modifications and variations can be made without departure from the spirit and scope of the present disclosure.

<Description of Characteristic Configuration>

Finally, the above-mentioned characteristic configuration of the present disclosure will be described again mainly with reference to the inkjet recording device shown in FIG. 1.

(Heat Transfer and Circulation Head)

In the present disclosure, as shown in FIG. 1, in order to heat an ink image on a transfer body to a temperature equal to or higher than the MFT, a transfer body 101 is heated during a period after the ejection of a liquid through a liquid ejection head (an ink applying device 104) and before the pressing of a recording medium 108 by means of a pressing unit (a pressing member 106). Namely, a heating unit 110 for heating the transfer body 101 during a period after the ejection of the liquid through the liquid ejection head and after the pressing of the recording medium by means of the pressing unit is provided. In this manner, in the pressing unit as a transfer part, the ink image is heated to a temperature equal to or higher than the MFT, and therefore the transfer properties of the image can be improved.

In both of a case where the transfer body 101 is heated from the support member 102 or a case where the transfer body 101 is heated before the transfer body 101 reaches the transfer part, the temperature of the liquid ejection head may be relatively high. As a result, the temperature of the ejection orifice may also be high, and therefore the volatilization of water or the like through the ejection orifice may be accelerated. This is true in a case where a cooling unit for cooling the transfer body 101 is provided. Namely, even when the transfer body 101 is heated by the heating unit 110 or the like and then cooled by the cooling unit, it is difficult to thoroughly cool the transfer body 101. Particularly when the transfer body 101 is a rotating body and it is intended to perform high-speed recording, the rotation speed of the transfer body 101 is increased and therefore it becomes difficult to thoroughly cool the transfer body 101. In this case, the transfer body 101 itself is heated and moves in a heated state to the region of the liquid ejection head 104 that serves as an ink applying device. When the transfer body 101 that is located several millimeters below the ejection orifice 13 of the liquid ejection head 104 is heated, the influence of the heat reaches the ink in an ejection orifice 13 (ejection orifice part 13*b*) and therefore the volatilization of a liquid through the ejection orifice may be accelerated.

In the present disclosure, in contrast, the ink (liquid) in the pressure chamber 23 in the liquid ejection head 104 can be circulated between the pressure chamber and the outside of the pressure chamber. Namely, the operation of ejection of the ink can be achieved while flowing the ink through a flow path (pressure chamber 23) located between an ejection orifice in the liquid ejection head and an energy-generating element. In this manner, the liquid in the pressure chamber 23 in the vicinity of the ejection orifice 13 and an ejection orifice part 13*b* can be flown (circulated), and consequently the flow also reaches the inside of the ejection orifice part 13*b*. Due to the influence of the heated transfer body, it becomes possible to flow an ink toward the downstream side of the pressure chamber 23 and supply a fresh ink that is free of the influence of thickening from the upstream side of the pressure chamber 23, even when water or the like is volatilized through the ejection orifice to thicken the ink or change the concentration of a coloring material. As a result, ejection failures such as the clogging of ejection orifices caused by the thickening of the ink or image unevenness caused by the change in concentration of a coloring material can be prevented.

As mentioned above, in the present disclosure, the transfer is carried out while heating the transfer body and a liquid is allowed to flow through a flow path between the ejection orifice in the liquid ejection head and the energy-generating element, and therefore it becomes possible to achieve both of the high properties to transfer onto the transfer body and the formation of a high-quality image. Furthermore, even when the transfer body onto which ejection is to be performed through the liquid ejection head is heated and the ejection is performed under conditions where the liquid ejection head has a relatively high temperature due to the influence of the heat, it becomes possible to perform the ejection of a liquid while eliminating the influence of the heat.

In a liquid ejection head in which the energy-generating element is a heat-generating element (a heater), the size of a flow path between the pressure chamber and the ejection orifice part is generally small, and therefore the shortage of supply of the ink is likely to occur due to the thickening of the ink caused by volatilization. The present disclosure can be applied preferably to a liquid ejection apparatus in which the energy-generating element is equipped with a liquid ejection head that is a heat-generating element.

(Cooling Mechanism)

In the present disclosure, as shown in FIG. 1, it is preferred that the heating unit in the transfer body is arranged on the downstream side from the liquid ejection head (ink applying device 104) and on the upstream side from the pressing unit (pressing member 106) as observed in the direction of the rotation of the transfer body. In addition, it is also preferred that a cooling unit for cooling the transfer body is provided on the downstream side from the pressing unit and on the upstream side from the liquid ejection head as observed in the direction of the rotation of the transfer body.

As shown in FIGS. 15A to 15C, the recording element substrate 10 can be cooled more easily by flowing a liquid through a flow path (pressure chamber 23) between the ejection orifice 13 of the liquid ejection head and the energy-generating element 15. Therefore, dew condensation may occur in the recording element substrate 10 to cause ejection failure, or condensed water may be dropped onto the transfer body to cause image failure. In order to overcome this disadvantage, the heating of the transfer body 101 is performed between the liquid ejection head 104 and the pressing unit (transfer part), and the transfer onto the recording medium 108 is performed in such a state that the transfer body in the pressing unit (transfer part) is in a relatively high temperature state. After the transfer, the transfer body 101 is cooled between the pressing unit and the liquid ejection head 104. In this manner, the temperature of the transfer body in the liquid ejection head can be further decreased. As a result, the occurrence of dew condensation at the liquid ejection head can be reduced.

Furthermore, it is preferred that the temperature of the energy-generating element 15 in the liquid ejection head is adjusted to a temperature higher than ambient temperature. In order to achieve this requirement, it is preferred that at least one member having a low heat conductivity, such as a resin member, is contained in a support member for the energy-generating element 15.

As mentioned above, the occurrence of dew condensation at the liquid ejection head can be reduced by arranging the heating unit 110 on the downstream side from the liquid ejection head 104 and on the upstream side from the pressing unit and arranging the cooling unit on the downstream side from the pressing unit and on the upstream side from the liquid ejection head 104. As a result, the decrease in image quality due to printing failure or dripping of an ink caused by dew condensation can be prevented.

The reaction liquid applying device 103 in FIG. 1 has a function to apply the reaction liquid and also serves as the above-mentioned cooling unit. In this manner, to provide two functions is preferred, because the space of the recording device can be reduced. A reaction liquid applying unit of this type can apply a reaction liquid having a lower temperature than the temperature of the heated transfer body onto the transfer body, and therefore can cool the transfer body. The liquid to be applied may be a clear ink for imparting glossiness. In order to prevent the change in concentrations of components which is caused by the volatilization of volatile components from the reaction liquid or the clear ink, it is preferred to arrange the reaction liquid applying unit at a position closer to the liquid ejection head. In other words, it is preferred to arrange a liquid applying device for applying a liquid such as a reaction liquid or a clear ink at a position closer to the liquid ejection head than the pressing unit as observed in the direction of the rotation of the transfer body.

As another example of the cooling unit, the cleaning member 109 in FIG. 1 may be used as the cooling unit. This is preferred, because the liquid ejection apparatus can be further downsized. The cleaning unit can cool the transfer body by bringing the cleaning member having a temperature lower than the heated transfer body into contact with the transfer body. When the cleaning is carried out immediately after the transfer, the progression of coagulation/fixing of residual materials can be reduced. Therefore, it is preferred to arrange the cleaning unit at a position closer to the pressing unit than the liquid ejection head as observed in the direction of the rotation of the transfer body. It is also possible to use both of the cleaning member 109 and the reaction liquid applying device 103 as the cooling unit.

As mentioned above, in order to achieve good transfer, the heating unit 110 is arranged on the upstream side from the transfer part and the cooling unit (the cleaning member 109 or the reaction liquid applying device 103) is arranged on the downstream side from the transfer part, whereby the occurrence of dew condensation in the liquid ejection head can be prevented. Furthermore, the volatilization of a liquid through the ejection orifice 13 in the liquid ejection head can be prevented by decreasing the temperature of the transfer body 101 by means of the cooling unit. Thus, the volatilization of a liquid through the ejection orifice 13 can be prevented by using both of the cooling unit and the circulation configuration of the pressure chamber 23 in the liquid ejection head 104.

(Liquid Absorbing Device)

In the present disclosure, as shown in FIG. 1, it is preferred to arrange a liquid absorbing device for absorbing a liquid component from an ink image on the transfer body on the downstream side from the liquid ejection head (the ink applying device 104) and on the upstream side from the heating unit 110 as observed in the direction of the rotation of the transfer body.

The ink ejected through the liquid ejection head causes the volatilization of water on the transfer body 101, and heat is drawn from the transfer body by the vaporization heat generated upon the volatilization. Particularly when the transfer body is heated to a high temperature, the volatilization is accelerated and therefore a large amount of heat is drawn from the transfer body. With respect to the ink applied onto the transfer body 101, the amount of the ink differs (i.e., the recording Duty differs) according to location in an image. Therefore, the amount of the vaporization heat differs according to location in the transfer body 101, and consequently unevenness in temperature occurs on the transfer body. Unevenness in temperature that occurs once is never recovered even when heated with a heating unit. The unevenness in temperature may cause the formation of a portion in which the temperature becomes equal to or lower than the MFT or a portion in which the temperature becomes too high in the transfer part (the pressing member 106). Furthermore, due to the unevenness in temperature in the transfer body, the spread of dots may be varied and therefore image unevenness may occur during the ejection of an ink onto the transfer body through the liquid ejection head.

In the present disclosure, in contrast, a liquid component contained in an ink image can be reduced by means of a pressing member for liquid absorption use in a liquid absorbing device in a region located on the downstream side from the liquid ejection head and on the upstream side from the heating unit. As a result, the liquid component can be removed before a large amount of liquid is volatilized by the heat of the transfer body 101, and therefore the occurrence of unevenness in temperature in the transfer body caused by vaporization heat can be reduced. In this manner, the transfer failure in the transfer part (the pressing member 106) or the image unevenness of the ink ejected through the liquid ejection head, which is caused as the result of the temperature unevenness in the transfer body, can be reduced.

(Resin Particles and Circulation Head)

The present disclosure is more effective in the case where an ink (a liquid) ejected through a liquid ejection head contains resin particles other than a coloring material.

If a solid content is high, a solid material is likely to be coagulated upon volatilization and, as a result, ejection failure caused by the increase in viscosity or ejection failure caused by the fixing of the solid material is likely to occur. Particularly under a high-temperature environment, the volatilization of water and the like is accelerated and therefore ejection failure may occur more frequently.

In the present disclosure, in contrast, the occurrence of the thickening or fixing of an ink caused by the volatilization of water or the like through the ejection orifice can be prevented and consequently the occurrence of ejection failure can be prevented by flowing a liquid through a flow path located between the ejection orifice in the liquid ejection head and the energy-generating element, as mentioned above. Therefore, in a transfer mode in which an ink containing resin particles other than a coloring material is heated to a temperature equal to or higher than the MFT, both of high transfer properties onto a transfer body and high-quality image formation can be achieved.

(Clear Ink and Circulation Head)

The present disclosure is more effective in a case where an ink (a liquid) ejected through a liquid ejection head is a transparent liquid containing no coloring material, i.e., a case where a clear ink is used for improving glossiness of an image or improving image transfer properties.

As mentioned above, when a solid content is high, a solid material is likely to be coagulated upon volatilization, often resulting in ejection failure due to the increase in viscosity or ejection failure due to the fixing of the solid material. A component capable of exerting adhesiveness is often thickened, and consequently ejection failure may also be caused. Particularly under a high-temperature environment, volatilization is accelerated and therefore ejection failure may be caused more frequently, often resulting in unevenness in gloss or transfer failure.

In the present disclosure, in contrast, the occurrence of the thickening or fixing of an ink caused by the volatilization of water or the like through the ejection orifice can be prevented and consequently the occurrence of ejection failure can be prevented by flowing a liquid through a flow path located between the ejection orifice in the liquid ejection head and the energy-generating element, as mentioned above. Therefore, in a case where a clear ink (a transparent liquid containing no coloring material) is used for improving glossiness of an image or improving image transfer properties, the unevenness in gloss or transfer failure can be prevented.

(Flow Mode)

The present disclosure can be applied to both of the above-mentioned flow modes A and B. For the formation of an image having higher quality, it is more preferred that the liquid ejection head is a liquid ejection head that can cause the above-mentioned flow mode A. In other words, it is more preferred that the height H of the pressure chamber as measured on the upstream side of the direction of the flow of the liquid relative to a part at which the pressure chamber communicates with the ejection orifice part, the length P of the ejection orifice part as measured in the direction of the ejection of the liquid, and the length W of the ejection orifice part as measured in the direction of the flow of the liquid satisfy the relationship represented by the formula: $H^{-0.34} \times P^{-0.66} \times W > 1.7$.

By using the liquid ejection head of this type, it becomes possible to prevent the occurrence of ejection failure by the influence of volatilization more effectively in a case where the solid content is high as shown in FIGS. 23A and 23B. Therefore, when an ink image is formed by using the ejection head of this type and ejecting an ink containing resin particles and then the ink image is heated to a temperature equal to or higher than the MFT, both of high transfer properties and the formation of a high-quality image can be achieved.

As mentioned above, a transfer-type liquid ejection apparatus using an intermediate transfer body as a liquid ejection apparatus is described in the embodiments. However, the present disclosure is not limited to these embodiments. For example, the present disclosure can be applied to a so-called "direct-recording-type" liquid ejection apparatus which can draw or record an image onto a recording medium directly without the need to use any intermediate transfer body. In this case, in order to improve the fixability of a liquid, a recording medium (e.g., paper) to be conveyed to the lower part of an ejection orifice 13 in a liquid ejection head is sometimes heated by means of a heating unit, and therefore the recording medium is heated. When a recording medium (e.g., paper) heated to a relatively high temperature is conveyed to immediately below the liquid ejection head continuously or intermittently, the liquid in the ejection orifice in the liquid ejection head is affected by heat, as in the case of the heated transfer body 101. The volatilization of the ink in an ejection orifice 13 and an ejection orifice 13*b* is accelerated by the influence of heat coming from the recording medium. However, as in the case of the configuration described in FIGS. 15A to 15C and others, the thickening of a liquid can be prevented by fluidizing (circulating) the ink in the pressure chamber 23 in the liquid ejection head.

As mentioned above, according to the present disclosure, it becomes possible to provide a liquid ejection apparatus which can eject a liquid while eliminating the influence of heat even when an ejection object medium (e.g., an intermediate transfer body, a recording medium) onto which ejection is carried out through a liquid ejection head is heated and the ejection has to be carried out under a relatively high temperature condition due to the influence of the heat.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131276, filed Jul. 4, 2017, which is hereby incorporated by reference herein in its entirety.

What is claimed is:

1. A liquid ejection apparatus comprising:

a liquid ejection head which communicates with an ejection orifice for ejecting a liquid therethrough and which is provided with a pressure chamber having, in the inside thereof, an energy-generating element configured to generate an energy to be utilized for the ejection of the liquid;

a transfer body onto which the liquid is ejected through the liquid ejection head to form an image;

a pressing unit which presses a recording medium against the transfer body to transfer an image formed on the transfer body onto the recording medium; and a heating unit for heating the transfer body during a period from the ejection of the liquid through the liquid ejection head and until the pressing of the recording medium by means of the pressing unit, wherein the liquid in the pressure chamber in the liquid ejection head is circulated between the pressure chamber and the outside of the pressure chamber, wherein the liquid ejection head includes: (1) an ejection orifice part that allows the ejection orifice and the pressure chamber to communicate with each other; (2) an inflow path through which a liquid can be flowed into the pressure chamber from the outside; and (3) an outflow path through which a liquid can be flowed outside from the pressure chamber, and wherein the height H in μm of the pressure chamber as measured on the upstream side of the direction of the flow of the liquid relative to a part at which the pressure chamber communicates with the ejection orifice part, the length P in μm of the ejection orifice part as measured in the direction of the ejection of the liquid, and the length W in μm of the ejection orifice part as measured in the direction of the flow of the liquid satisfy the relationship represented by the formula: $H^{-0.34} \times P^{-0.66} \times W > 1.7$.

2. The liquid ejection apparatus according to claim 1, wherein the transfer body is a rotating body that rotates between the liquid ejection head and the pressing unit, and wherein the heating unit is arranged on the downstream side from the liquid ejection head and on the upstream side from the pressing unit as observed in the direction of the rotation of the transfer body.

3. The liquid ejection apparatus according to claim 2, wherein a cooling unit for cooling the transfer body is provided on the downstream side from the pressing unit and on the upstream side from the liquid ejection head as observed in the direction of the rotation of the transfer body.

4. The liquid ejection apparatus according to claim 3, wherein the cooling unit includes a liquid applying unit for applying a liquid onto the transfer body.

5. The liquid ejection apparatus according to claim 4, wherein the liquid applying unit is configured to apply a reaction liquid for reacting with the liquid ejected onto the transfer body through the liquid ejection head.

6. The liquid ejection apparatus according to claim 4, wherein the liquid applying unit is arranged at a position that is closer to the liquid ejection head than the pressing unit as observed from the direction of the rotation of the transfer body.

7. The liquid ejection apparatus according to claim 3, wherein the cooling unit includes a cleaning unit for cleaning the surface of the transfer body.

8. The liquid ejection apparatus according to claim 7, wherein the cleaning unit is arranged at a position that is closer to the pressing unit than the liquid ejection head as observed in the direction of the rotation of the transfer body.

9. The liquid ejection apparatus according to claim 2, further comprising a liquid absorbing device on the downstream side from the liquid ejection head and on the upstream side of the heating unit as observed in the direction of the rotation of the transfer body, wherein the liquid absorbing device comprises a liquid absorbing member comprising a porous body, is configured to cause the porous body to contact with an image of the liquid ejected from the transfer body, and is configured to absorb at least a portion of a liquid component from the image of the liquid to concentrate the liquid forming the image of the liquid.

10. The liquid ejection apparatus according to claim 1, wherein the liquid ejected through the liquid ejection head comprises resin particles other than a coloring material.

11. The liquid ejection apparatus according to claim 1, wherein the liquid ejected through the liquid ejection head is a transparent liquid containing no coloring material.

12. The liquid ejection apparatus according to claim 1, wherein the energy-generating element is a heat-generating element.

13. The liquid ejection apparatus according to claim 1, further comprising a plurality of recording element substrates each including the energy-generating element, wherein the plurality of recording element substrates are arranged in an in-line configuration.

* * * * *